US010582303B2

(12) United States Patent
van Halteren et al.

(10) Patent No.: US 10,582,303 B2
(45) Date of Patent: Mar. 3, 2020

(54) BALANCED ARMATURE RECEIVER WITH BI-STABLE BALANCED ARMATURE

(71) Applicant: Sonion Nederland B.V., Hoofddorp (NL)

(72) Inventors: Aart Zeger van Halteren, Woudenberg (NL); Paul Christiaan van Hal, Amsterdam (NL); Hamidreza Taghavi, Eindhoven (NL); Andreas Tiefenau, Koog aan de Zaan (NL); Wouter Bruins, Utrecht (NL)

(73) Assignee: SONION NEDERLAND B.V., Hoofddorp (NL)

( * ) Notice: Subject to any disclaimer, the term of this patent is extended or adjusted under 35 U.S.C. 154(b) by 0 days.

(21) Appl. No.: 15/366,238

(22) Filed: Dec. 1, 2016

(65) Prior Publication Data

US 2017/0164115 A1 Jun. 8, 2017

Related U.S. Application Data

(60) Provisional application No. 62/263,285, filed on Dec. 4, 2015.

(51) Int. Cl.

| | |
|---|---|
| ***H04R 25/00*** | (2006.01) |
| ***H04R 11/04*** | (2006.01) |
| ***H04R 11/02*** | (2006.01) |

(52) U.S. Cl.

CPC ..... *H04R 11/04* (2013.01); *H04R 11/02* (2013.01); *H04R 25/604* (2013.01); *H04R 2225/021* (2013.01); *H04R 2460/05* (2013.01); *H04R 2460/11* (2013.01)

(58) Field of Classification Search

CPC ..... H04R 11/04; H04R 11/02; H04R 25/604; H04R 2225/021; H04R 2460/05; H04R 2460/11

USPC ..... 381/417, 386

See application file for complete search history.

(56) References Cited

U.S. PATENT DOCUMENTS

| | | | | |
|---|---|---|---|---|
| 2,325,688 A | | 8/1943 | Landis | |
| 4,956,868 A | * | 9/1990 | Carlson | H04R 11/00 381/189 |
| 6,788,796 B1 | | 9/2004 | Miles et al. | |
| 6,831,577 B1 | | 12/2004 | Furst | |
| 6,853,290 B2 | | 2/2005 | Jorgensen et al. | |

(Continued)

FOREIGN PATENT DOCUMENTS

| | | |
|---|---|---|
| CN | 101 340 738 A | 1/2009 |
| DE | 19942707 A1 | 3/2001 |

(Continued)

OTHER PUBLICATIONS

European Patent Office, Partial European Search Report for Application No. EP 16201638.0, dated Apr. 6, 2017 (7 pages).

(Continued)

*Primary Examiner* — Phylesha Dabney
(74) *Attorney, Agent, or Firm* — Nixon Peabody LLP

(57) ABSTRACT

A balanced armature receiver is disclosed that includes a housing and an armature assembly within the housing. The armature assembly includes a first armature portion and a second armature portion. The first armature portion and the second armature portion are operated such that the second armature portion is substantially unstable relative to the first armature portion.

20 Claims, 23 Drawing Sheets

(56) References Cited

U.S. PATENT DOCUMENTS

| | | | |
|---|---|---|---|
| 6,859,542 | B2 | 2/2005 | Johannsen et al. |
| 6,888,408 | B2 | 5/2005 | Furst et al. |
| 6,914,992 | B1 | 7/2005 | van Halteren et al. |
| 6,919,519 | B2 | 7/2005 | Ravnkilde et al. |
| 6,930,259 | B1 | 8/2005 | Jorgensen et al. |
| 6,943,308 | B2 | 9/2005 | Ravnkilde et al. |
| 6,974,921 | B2 | 12/2005 | Jorgensen et al. |
| 7,008,271 | B2 | 3/2006 | Jorgensen |
| 7,012,200 | B2 | 3/2006 | Moller |
| 7,062,058 | B2 | 6/2006 | Steeman et al. |
| 7,062,063 | B2 | 6/2006 | Hansen et al. |
| 7,072,482 | B2 | 7/2006 | Van Doorn et al. |
| 7,088,839 | B2 | 8/2006 | Geschiere et al. |
| 7,110,560 | B2 | 9/2006 | Stenberg |
| 7,136,496 | B2 | 11/2006 | van Halteren et al. |
| 7,142,682 | B2 | 11/2006 | Mullenborn et al. |
| 7,181,035 | B2 | 2/2007 | van Halteren et al. |
| 7,190,803 | B2 | 3/2007 | van Halteren |
| 7,206,428 | B2 | 4/2007 | Geschiere et al. |
| 7,221,767 | B2 | 5/2007 | Mullenborn et al. |
| 7,221,769 | B1 | 5/2007 | Jorgensen |
| 7,227,968 | B2 | 6/2007 | van Heltren et al. |
| 7,239,714 | B2 | 7/2007 | de Blok et al. |
| 7,245,734 | B2 | 7/2007 | Niederdraenk |
| 7,254,248 | B2 | 8/2007 | Johannsen et al. |
| 7,286,680 | B2 | 10/2007 | Steeman et al. |
| 7,292,700 | B1 | 11/2007 | Engbert et al. |
| 7,292,876 | B2 | 11/2007 | Bosh et al. |
| 7,336,794 | B2 | 2/2008 | Furst et al. |
| 7,376,240 | B2 | 5/2008 | Hansen et al. |
| 7,403,630 | B2 | 7/2008 | Jorgensen et al. |
| 7,415,121 | B2 | 8/2008 | Mögelin et al. |
| 7,425,196 | B2 | 9/2008 | Jorgensen et al. |
| 7,460,681 | B2 | 12/2008 | Geschiere et al. |
| 7,466,835 | B2 | 12/2008 | Stenberg et al. |
| 7,492,919 | B2 | 2/2009 | Engbert et al. |
| 7,548,626 | B2 | 6/2009 | Stenberg et al. |
| 7,657,048 | B2 | 2/2010 | van Halteren et al. |
| 7,684,575 | B2 | 3/2010 | van Halteren et al. |
| 7,706,561 | B2 | 4/2010 | Wilmink et al. |
| 7,715,583 | B2 | 5/2010 | Van Halteren et al. |
| 7,728,237 | B2 | 6/2010 | Pedersen et al. |
| 7,809,151 | B2 | 10/2010 | Van Halteren et al. |
| 7,822,218 | B2 | 10/2010 | Van Halteren |
| 7,899,203 | B2 | 3/2011 | Van Halteren et al. |
| 7,912,240 | B2 | 3/2011 | Madaffari et al. |
| 7,946,890 | B1 | 5/2011 | Bondo et al. |
| 7,953,241 | B2 | 5/2011 | Jorgensen et al. |
| 7,961,899 | B2 | 6/2011 | Van Halteren et al. |
| 7,970,161 | B2 | 6/2011 | van Halteren |
| 8,098,854 | B2 | 1/2012 | van Halteren et al. |
| 8,101,876 | B2 | 1/2012 | Andreasen et al. |
| 8,103,039 | B2 | 1/2012 | van Halteren et al. |
| 8,160,290 | B2 | 4/2012 | Jorgensen et al. |
| 8,170,249 | B2 | 5/2012 | Halteren |
| 8,189,804 | B2 | 5/2012 | Hruza |
| 8,189,820 | B2 | 5/2012 | Wang |
| 8,223,996 | B2 | 7/2012 | Beekman et al. |
| 8,233,652 | B2 | 7/2012 | Jorgensen et al. |
| 8,259,963 | B2 | 9/2012 | Stenberg et al. |
| 8,259,976 | B2 | 9/2012 | van Halteren |
| 8,259,977 | B2 | 9/2012 | Jorgensen et al. |
| 8,280,082 | B2 | 10/2012 | van Halteren et al. |
| 8,284,966 | B2 | 10/2012 | Wilk et al. |
| 8,313,336 | B2 | 11/2012 | Bondo et al. |
| 8,315,422 | B2 | 11/2012 | van Halteren et al. |
| 8,331,595 | B2 | 12/2012 | van Halteren |
| 8,369,552 | B2 | 2/2013 | Engbert et al. |
| 8,379,899 | B2 | 2/2013 | van Halteren et al. |
| 8,509,468 | B2 | 8/2013 | van Halteren et al. |
| 8,526,651 | B2 | 9/2013 | Lafort et al. |
| 8,526,652 | B2 | 9/2013 | Ambrose et al. |
| 8,798,304 | B2 | 8/2014 | Miller |
| 2008/0063223 | A1* | 3/2008 | van Halteren ..... H04R 1/24 381/182 |
| 2010/0067730 | A1 | 3/2010 | van Halteren |
| 2011/0182453 | A1 | 7/2011 | van Hal et al. |
| 2011/0189880 | A1 | 8/2011 | Bondo et al. |
| 2011/0299708 | A1 | 12/2011 | Bondo et al. |
| 2011/0299712 | A1 | 12/2011 | Bondo et al. |
| 2011/0311069 | A1 | 12/2011 | Ambrose et al. |
| 2012/0014548 | A1 | 1/2012 | van Halteren |
| 2012/0027245 | A1 | 2/2012 | van Halteren et al. |
| 2012/0140966 | A1 | 6/2012 | Mocking et al. |
| 2012/0155683 | A1 | 6/2012 | van Halteren |
| 2012/0155694 | A1 | 6/2012 | Reeuwijk et al. |
| 2012/0255805 | A1 | 10/2012 | van Halteren et al. |
| 2013/0028451 | A1 | 1/2013 | de Roo |
| 2013/0136284 | A1 | 5/2013 | van Hal et al. |
| 2013/0142370 | A1 | 6/2013 | Engbert et al. |
| 2013/0163799 | A1 | 6/2013 | Van Halteren |
| 2013/0195295 | A1 | 8/2013 | van Halteren et al. |
| 2014/0314253 | A1* | 10/2014 | Zhou ..... H04R 1/02 381/162 |
| 2016/0044420 | A1* | 2/2016 | Albahri ..... H04R 11/02 381/185 |
| 2016/0255433 | A1 | 9/2016 | Grinker |
| 2017/0208382 | A1 | 7/2017 | Grinker |
| 2017/0295425 | A1 | 10/2017 | Grinker |
| 2018/0160213 | A1 | 6/2018 | Grinker |

FOREIGN PATENT DOCUMENTS

| | | | |
|---|---|---|---|
| EP | 0 127 247 | A2 | 12/1984 |
| EP | 1895811 | A2 | 3/2008 |
| EP | 1895811 | A3 | 8/2014 |
| WO | 2014030998 | A1 | 2/2014 |

OTHER PUBLICATIONS

Extended European Search Report for European Application No. EP 16201638.0 dated Aug. 8, 2017 (12 pages).

* cited by examiner

BALANCED ARMATURE RECEIVER WITH BI-STABLE BALANCED ARMATURE

FIELD OF THE INVENTION

The present invention relates to balanced armature receivers. In particular, the present invention relates to balanced armature receivers with an acoustic valve.

BACKGROUND OF THE INVENTION

Acoustic devices exist that fit into, at least partially, a user's ear canal, such as receiver-in-canal (RIC) hearing aids, personal listening devices, including in-ear headphones, and the like. For certain purposes, there is a benefit for such acoustic devices to have an open fitting or a closed fitting, such as back volumes, open/closed domes, vented shells, etc. As such, RIC hearing aids come in open or closed domes to provide for either open fittings or closed fittings, respectively. For an open fitting, acoustic signals are allowed to pass through the acoustic devices. Acoustic devices with an open fitting allow the natural passage of sound to the ear, which eliminates the occlusion effect. However, in an open fitting, the user may hear less of low frequencies. For a closed fitting, acoustic signals are not allowed (or at least limited) to pass through the devices. For acoustic devices with a closed fitting, loud background noise can be passively blocked by the closed fitting to better control the sound that reaches the ear. However, in a closed fitting, the occlusion effect generates unnatural sound.

Accordingly, a need exists for acoustic valves within acoustic devices that allow for the acoustic devices to switch between an open fitting and a closed fitting. Further, based on space constraints for such acoustic devices, a need exists for an active valve that does not impact the overall size of the acoustic devices.

SUMMARY OF INVENTION

According to aspects of the present disclosure, a balanced armature receiver is disclosed with two integrated balanced armatures. One of the balanced armatures controls a diaphragm to generate acoustic signals. The other of the balanced armatures controls an acoustic valve to modify the balanced armature receiver between an open and closed fitting.

Additional aspects of the present disclosure include a receiver including a housing. Within the housing is a balanced armature receiver within the housing that has an armature. The housing further includes a second armature electromechanically operated to impart mechanical movement to a part substantially independently of movement of the armature of the balanced armature receiver.

Still additional aspects of the present disclosure include a receiver having an electric drive coil forming a tunnel with a central longitudinal axis. The receiver further has a first pair of permanent magnets forming a first gap between facing surfaces of the first pair of permanent magnets. The first gap is parallel to the central longitudinal axis. The receiver further has an armature assembly that includes a first deflectable armature and a second deflectable armature. The first deflectable armature extends longitudinally through the tunnel and within the first gap. The second deflectable armature extends longitudinally through the tunnel. A drive rod couples the second deflectable armature to an acoustic valve. The second deflectable armature is electromechanically operated to impart mechanical movement to the acoustic valve substantially independently of mechanical movement of the first deflectable armature.

Yet additional aspects of the present disclosure include a balanced armature receiver. The receiver includes a first pair of permanent magnets forming a first gap between facing surfaces of the first pair of permanent magnets. The receiver also includes a first electric drive coil forming a first tunnel with a first central longitudinal axis. The first central longitudinal axis is aligned with the first gap. The receiver also includes a second electric drive coil forming a second tunnel with a second central longitudinal axis. The second longitudinal axis is parallel to the first gap. The receiver also includes an armature assembly including a first deflectable armature and a second deflectable armature. The first deflectable armature extends longitudinally through the first tunnel and within the first gap. The second deflectable armature extends longitudinally through the second tunnel. The receiver further includes a drive rod coupling the second deflectable armature to an acoustic valve. The second deflectable armature is unstable relative to the first deflectable armature based, at least in part, on energized states of the first electric drive coil and the second electric drive coil.

Further aspects of the present disclosure include an actuator. The actuator includes a housing and an electric drive coil within the housing that forms a tunnel. An armature extends through the tunnel and directly couples to the electric drive coil. The armature has a deflectable portion. Energizing the electric drive coil deflects the deflectable portion of the armature between a first state and a second state.

Further aspects of the present disclosure include a method of using a receiver. The receiver includes a housing having a first balanced armature coupled to a diaphragm and a second balanced armature coupled to an acoustic valve. The method includes determining one or more acoustic signals external to the receiver; energizing one or more electric drive coils associated with the first armature to reproduce the one or more acoustic signals with the diaphragm; determining a state of the acoustic valve; and energizing one or more electric drive coils associated with the second armature based, at least in part, on the state of the acoustic valve.

Additional aspects of the present disclosure include a method of detecting a state of an acoustic valve coupled to a balanced armature within a receiver. The method includes determining an impedance curve as a function of frequency through the balanced armature collapsed against one of two of permanent magnets (which exhibit hysteresis curves that vary); comparing the determined impedance to known impedances for the balanced armature collapsed against each of the two permanent magnets; and determining a state of the acoustic valve based on the comparison.

According to additional aspects, disclosed is an Embodiment A that includes a balanced armature receiver is disclosed. The balanced armature receiver includes a housing and an armature assembly within the housing. The armature assembly includes a first armature portion and a second armature portion. The first armature portion and the second armature portion are operated such that the second armature portion is substantially unstable relative to the first armature portion.

Additional aspects of Embodiment A, and every other embodiment disclosed herein, further include the second armature portion being unstable relative to the first armature portion based, at least in part, on a difference in one or more mechanical or magnetic properties of the second armature portion relative to the first armature portion.

Additional aspects of Embodiment A, and every other embodiment disclosed herein, further include the one or more mechanical properties being rigidity, and the second armature portion being less rigid than the first armature portion.

Additional aspects of Embodiment A, and every other embodiment disclosed herein, further include a first electric drive coil forming a first tunnel with a first central longitudinal axis, and a second electric drive coil forming a second tunnel with a second central longitudinal axis. The first armature portion being aligned with the first central longitudinal axis and extending through the first electric drive coil. The second armature portion being aligned with the second central longitudinal axis and extending through the second electric drive coil. The second armature portion being unstable relative to the first armature portion based, at least in part, on a difference in energized states of the first electric drive coil relative to the second electric drive coil.

Additional aspects of Embodiment A, and every other embodiment disclosed herein, further include the second armature portion being directly coupled to the second electric drive coil.

Additional aspects of Embodiment A, and every other embodiment disclosed herein, further include the second electric drive coil being coupled to a moving portion of the second armature portion.

Additional aspects of Embodiment A, and every other embodiment disclosed herein, further include the second electric drive coil being coupled to a substantially non-moving portion of the second armature portion.

Additional aspects of Embodiment A, and every other embodiment disclosed herein, further include a first pair of permanent magnets forming a first gap between facing surfaces of the first pair of permanent magnets, and a second pair of permanent magnets forming a second gap between facing surfaces of the second pair of permanent magnets. Each of the second pair of permanent magnets having a spacer coupled thereto. The first armature portion extending within the first gap. The second armature portion extending within the second gap. The second armature portion being unstable relative to the first armature portion based, at least in part, on a difference in magnetic strengths of the first pair of permanent magnets relative to the second pair of permanent magnets.

Additional aspects of Embodiment A, and every other embodiment disclosed herein, further include the second pair of permanent magnets being rare earth magnets, and the spacers being formed of a substantially non-magnetic material.

Additional aspects of Embodiment A, and every other embodiment disclosed herein, further include at least one permanent magnet on the second armature portion. The second armature portion being bi-stable based, at least in part, on the at least one permanent magnet.

Additional aspects of Embodiment A, and every other embodiment disclosed herein, further include the first armature portion being a portion of a first armature of the armature assembly, and the second armature portion being a portion of a second armature of the armature assembly, and the first and second armatures being separate armatures.

Additional aspects of Embodiment A, and every other embodiment disclosed herein, further include the first armature being a generally U-shaped armature.

Additional aspects of Embodiment A, and every other embodiment disclosed herein, further include the second armature being a generally U-shaped armature.

Additional aspects of Embodiment A, and every other embodiment disclosed herein, further include the second armature being a substantially flat armature.

Additional aspects of Embodiment A, and every other embodiment disclosed herein, further include the second armature being a generally E-shaped armature.

Additional aspects of Embodiment A, and every other embodiment disclosed herein, further include the first armature being a substantially flat armature.

Additional aspects of Embodiment A, and every other embodiment disclosed herein, further include the first armature being a generally E-shaped armature.

Additional aspects of Embodiment A, and every other embodiment disclosed herein, further include the first armature portion and the second armature portion being portions of a single armature of the armature assembly.

Additional aspects of Embodiment A, and every other embodiment disclosed herein, further include the single armature being a generally U-shaped armature.

Additional aspects of Embodiment A, and every other embodiment disclosed herein, further include the single armature being a generally E-shaped armature.

Additional aspects of Embodiment A, and every other embodiment disclosed herein, further include the single armature being a substantially flat armature.

Additional aspects of Embodiment A, and every other embodiment disclosed herein, further include an acoustic pathway within the housing through which an acoustic signal travels, an acoustic valve within the acoustic pathway, and a drive pin coupling the second armature portion to the acoustic valve. The second armature portion being substantially unstable such that the acoustic valve is either substantially open or substantially closed during operation.

Additional aspects of Embodiment A, and every other embodiment disclosed herein, further include a default state of the acoustic valve being open.

Additional aspects of Embodiment A, and every other embodiment disclosed herein, further include the acoustic valve being a hinged flap.

Additional aspects of Embodiment A, and every other embodiment disclosed herein, further include the drive pin coupling to the hinged flap to provide a mechanical advantage factor of about 2 to 10.

Additional aspects of Embodiment A, and every other embodiment disclosed herein, further include a resilient member coupled to the second armature portion, a valve seat surrounding the acoustic valve, or a combination thereof.

Additional aspects of Embodiment A, and every other embodiment disclosed herein, further include the acoustic valve substantially open provides an aperture with an area of about 0.5 to 10 square millimeters ($mm^2$).

Additional aspects of Embodiment A, and every other embodiment disclosed herein, further include the acoustic valve being a membrane-based flip-flop valve.

Additional aspects of Embodiment A, and every other embodiment disclosed herein, further include the acoustic valve being formed of electro-active polymers.

Additional aspects of Embodiment A, and every other embodiment disclosed herein, further include the receiver being incorporated into a hearing aid or a personal listening device.

Additional aspects of Embodiment A, and every other embodiment disclosed herein, further include the receiver being incorporated into the hearing aid as a woofer, and the hearing aid further including a tweeter.

Additional aspects of Embodiment A, and every other embodiment disclosed herein, further include the hearing aid being a receiver-in-canal hearing aid.

Additional aspects of Embodiment A, and every other embodiment disclosed herein, further include the hearing aid being an in-the-ear hearing aid.

Additional aspects of Embodiment A, and every other embodiment disclosed herein, further include a controller that controls an unstable state of the second armature portion based, at least in part, on an electric current pulse.

Additional aspects of Embodiment A, and every other embodiment disclosed herein, further include the controller being a discrete signal processor (DSP) that monitors one or more acoustic signals to control the unstable state of the second armature portion.

Additional aspects of Embodiment A, and every other embodiment disclosed herein, further include the controller being an application running on a smartphone that generates the electric current pulse in response to one or more selections of a user.

According to additional aspects, disclosed is an Embodiment B that includes a receiver. The receiver includes a housing and a balanced armature receiver. The balanced armature receiver is within the housing and has an armature. The receiver also includes a second armature also within the housing and electromechanically operated to impart mechanical movement to a part substantially independently of movement of the armature of the balanced armature receiver.

Additional aspects of Embodiment B, and every other embodiment disclosed herein, further include the second armature including a bi-stable valve that draws electrical current pulse only to impart the mechanical movement to the part.

Additional aspects of Embodiment B, and every other embodiment disclosed herein, further include the second armature imparting the mechanical movement to the part among at least two distinct positions.

Additional aspects of Embodiment B, and every other embodiment disclosed herein, further include the second armature imparting mechanical movement to the part among at least three distinct positions.

Additional aspects of Embodiment B, and every other embodiment disclosed herein, further include the at least two distinct positions including an open position for the part and a closed position for the part.

Additional aspects of Embodiment B, and every other embodiment disclosed herein, further include the part permitting acoustic signals to pass around the part in the open position, and the part substantially inhibiting acoustic signals from passing through the part in the closed position, the part including a valve.

Additional aspects of Embodiment B, and every other embodiment disclosed herein, further include the second armature being a balanced armature.

Additional aspects of Embodiment B, and every other embodiment disclosed herein, further include the second armature including a mass at a movable portion of the balanced armature.

Additional aspects of Embodiment B, and every other embodiment disclosed herein, further include the mass including a permanent magnet.

Additional aspects of Embodiment B, and every other embodiment disclosed herein, further include the second armature lacking magnets around the balanced armature portion of the second armature.

Additional aspects of Embodiment B, and every other embodiment disclosed herein, further include the receiver being incorporated into a hearing aid or a personal listing device.

Additional aspects of Embodiment B, and every other embodiment disclosed herein, further include the receiver being a receiver-in-canal (RIC).

Additional aspects of Embodiment B, and every other embodiment disclosed herein, further include the receiver being in the hearing aid, which is an in-the-ear (ITE) hearing aid.

Additional aspects of Embodiment B, and every other embodiment disclosed herein, further include the receiver being incorporated into a personal listening device.

Additional aspects of Embodiment B, and every other embodiment disclosed herein, further include the personal listening device is in-ear headphones.

Additional aspects of Embodiment B, and every other embodiment disclosed herein, further include the second armature being electromechanically operated to impart mechanical movement to switch the part between two states based, at least in part, on one or more user inputs on a smartphone.

Additional aspects of Embodiment B, and every other embodiment disclosed herein, further include the second armature being a balanced armature, the receiver including an upper magnet and a lower magnet positioned on either side of the balanced armature, the receiver including a common coil that surrounds the armature of the balanced armature receiver and the second armature.

Additional aspects of Embodiment B, and every other embodiment disclosed herein, further include the common coil being connected directly to the second armature.

Additional aspects of Embodiment B, and every other embodiment disclosed herein, further include the common coil being connected directly to the second armature by an adhesive.

Additional aspects of Embodiment B, and every other embodiment disclosed herein, further include the second armature having a substantially flat shape, a generally U-shape, or a generally E-shape.

Additional aspects of Embodiment B, and every other embodiment disclosed herein, further include the second armature being a balanced armature, the balanced armature receiver including a coil imparting electromagnetic energy to the armature of the balanced armature receiver, the receiver including a second coil imparting electromagnetic energy to the second armature.

Additional aspects of Embodiment B, and every other embodiment disclosed herein, further include the second coil being connected directly to the second armature.

Additional aspects of Embodiment B, and every other embodiment disclosed herein, further include the second armature imparting the mechanical movement to the part based on at least a frequency of sound produced by the balanced armature receiver.

Additional aspects of Embodiment B, and every other embodiment disclosed herein, further include the second armature imparting the mechanical movement to the part based on at least a type of sound produced by the balanced armature receiver.

Additional aspects of Embodiment B, and every other embodiment disclosed herein, further include the mechanical movement to the part producing a sound as the part moves.

Additional aspects of Embodiment B, and every other embodiment disclosed herein, further include the part including an inner tube having in its side an opening and an outer tube having in its side an opening, the inner tube and the outer tube being mutually coaxial.

According to additional aspects, disclosed is an Embodiment C that includes a balanced armature receiver. The receiver includes an electric drive coil forming a tunnel with a central longitudinal axis, a first pair of permanent magnets forming a first gap between facing surfaces of the first pair of permanent magnets, the first gap being parallel to the central longitudinal axis, and an armature assembly including a first deflectable armature extending longitudinally through the tunnel and within the first gap, and a second deflectable armature extending longitudinally through the tunnel. The receiver also includes a drive rod coupling the second deflectable armature to an acoustic valve. The second deflectable armature being electromechanically operated to impart mechanical movement to the acoustic valve substantially independent of mechanical movement of the first deflectable armature.

Additional aspects of Embodiment C, and every other embodiment disclosed herein, further include the second deflectable armature extending within the gap, and the second deflectable armature being substantially independent based, at least in part, on a difference in one or more mechanical properties of the second deflectable armature relative to the first deflectable armature.

Additional aspects of Embodiment C, and every other embodiment disclosed herein, further include the one or more mechanical properties being rigidity, and the second deflectable armature being less rigid than the first deflectable armature.

Additional aspects of Embodiment C, and every other embodiment disclosed herein, further include the second deflectable armature being bi-stable such that the acoustic valve remains closed or open independent of an energized state of the electric drive coil.

Additional aspects of Embodiment C, and every other embodiment disclosed herein, further include an electrical current pulse to the electrical drive coil switching the second deflectable armature between bi-stable states.

Additional aspects of Embodiment C, and every other embodiment disclosed herein, further include a magnet coupled to the second deflectable armature. The second deflectable portion being substantially independent based, at least in part, on the magnet.

Additional aspects of Embodiment C, and every other embodiment disclosed herein, further include the magnet being a rare earth magnet.

Additional aspects of Embodiment C, and every other embodiment disclosed herein, further include the second deflectable armature being bi-stable such that the acoustic valve remains closed or open independent of an energized state of the electric drive coil based, at least in part, on the magnet.

Additional aspects of Embodiment C, and every other embodiment disclosed herein, further include an acoustic pathway through which an acoustic signal travels. A deflection of the second deflectable armature between unstable states opening or closing the acoustic pathway based on opening or closing the acoustic valve.

Additional aspects of Embodiment C, and every other embodiment disclosed herein, further include a second pair of permanent magnets forming a second gap between facing surfaces of the second pair of permanent magnets, the second gap being aligned with the central longitudinal axis and adjacent to the first gap. The second deflectable portion of the second armature being substantially independent based, at least in part, on a difference in magnetic strength between the first pair of permanent magnets and the second pair of permanent magnets.

Additional aspects of Embodiment C, and every other embodiment disclosed herein, further include the second pair of permanent magnets being rare earth magnets.

Additional aspects of Embodiment C, and every other embodiment disclosed herein, further include the electric drive coil being coupled directly to the second deflectable armature.

Additional aspects of Embodiment C, and every other embodiment disclosed herein, further include the first deflectable armature and the second deflectable armature being separate armatures within the armature assembly.

According to additional aspects, disclosed is an Embodiment D that includes a balanced armature receiver. The receiver including a first pair of permanent magnets forming a first gap between facing surfaces of the first pair of permanent magnets, a first electric drive coil forming a first tunnel with a first central longitudinal axis, the first central longitudinal axis being substantially aligned with the first gap, and a second electric drive coil forming a second tunnel with a second central longitudinal axis, the second longitudinal axis being substantially parallel to the first gap. The receiver also including an armature assembly that includes a first deflectable armature extending longitudinally through the first tunnel and within the first gap, and a second deflectable armature extending longitudinally through the second tunnel. The receiver also includes a drive rod coupling the second deflectable armature to an acoustic valve. The second deflectable armature being substantially unstable relative to the first deflectable armature based, at least in part, on energized states of the first electric drive coil and the second electric drive coil.

Additional aspects of Embodiment D, and every other embodiment disclosed herein, further include the second deflectable armature being bi-stable such that the acoustic valve remains closed or open independent of an energized state of the second electric drive coil.

Additional aspects of Embodiment D, and every other embodiment disclosed herein, further include the second electric drive coil being directly coupled to the second deflectable armature portion.

Additional aspects of Embodiment D, and every other embodiment disclosed herein, further include a second pair of permanent magnets forming a second gap between facing surfaces of the second pair of permanent magnets; the second gap being aligned with the second central longitudinal axis and adjacent to the first gap. The second deflectable armature being unstable relative to the first deflectable armature based, at least in part, on a difference in magnetic strength between the first pair of permanent magnets and the second pair of permanent magnets.

According to additional aspects, disclosed is an Embodiment E of an actuator. The actuator includes a housing, an electric drive coil within the housing forming a tunnel, and an armature extending through the tunnel and directly coupling to the electric drive coil, the armature having a deflectable portion. Energizing the electric drive coil deflects the deflectable portion of the armature between a first state and a second state.

Additional aspects of Embodiment E, and every other embodiment disclosed herein, further include the armature being a generally U-shaped armature, and the electric drive coil being directly coupled to the substantially non-moving portion of the armature.

Additional aspects of Embodiment E, and every other embodiment disclosed herein, further include the armature being a generally E-shaped armature and the electric drive coil being directly coupled to the substantially non-moving portion of the armature.

Additional aspects of Embodiment E, and every other embodiment disclosed herein, further include the armature being a substantially flat armature and the electric drive coil being directly wound around the substantially non-moving portion of the armature.

Additional aspects of Embodiment E, and every other embodiment disclosed herein, further include an acoustic pathway through which an acoustic signal may travel between a first point exterior to the housing and a second point interior to the housing, an acoustic valve within the auditory pathway, and a drive rod connecting the deflectable portion of the armature to the acoustic valve. Energizing the electric drive coil deflects the deflectable portion of the armature to substantially open or close the acoustic valve.

Additional aspects of Embodiment E, and every other embodiment disclosed herein, further include a rare earth magnet coupled to the deflectable portion of the armature. Energizing the electric drive coil deflects the deflectable portion of the armature between a stable open position of the acoustic valve and a stable closed position of the acoustic valve based on the rare earth magnet.

According to additional aspects, disclosed is an Embodiment F that describes a method of using a receiver as described according to any embodiment disclosed herein. The receiver including a housing having a first balanced armature coupled to a diaphragm and a second balanced armature coupled to an acoustic valve. Aspects of the method include determining one or more acoustic signals external to the receiver, energizing one or more electric drive coils associated with the first armature to reproduce the one or more acoustic signals with the diaphragm, determining a state of the acoustic valve based on the reproduction of the one or more acoustic signals, and energizing one or more electric drive coils associated with the second armature based, at least in part, on the state of the acoustic valve.

Additional aspects of Embodiment F, and every other embodiment disclosed herein, further include analyzing a frequency range of the one or more acoustic signals to determine the state of the acoustic valve, and energizing the one or more electric drive coils associated with the second armature based, at least in part, on the frequency range of the one or more acoustic signals.

Additional aspects of Embodiment F, and every other embodiment disclosed herein, further include the one or more electric drive coils associated with the second armature being energized to close the acoustic valve based on the frequency range satisfying a low frequency threshold.

Additional aspects of Embodiment F, and every other embodiment disclosed herein, further include the one or more electric drive coils associated with the second armature being energized to open the acoustic valve based on the frequency range satisfying a high frequency threshold.

Additional aspects of Embodiment F, and every other embodiment disclosed herein, further include receiving one or more inputs from an application executed on a smartphone, and energizing one or more electric drive coils associated with the second armature based, at least in part, on the one or more inputs.

Additional aspects of Embodiment F, and every other embodiment disclosed herein, further include de-energizing the one or more electric drive coils associated with the second armature based, at least in part, on achieving a desired state of the acoustic valve.

According to additional aspects, disclosed is an Embodiment G that describes a method of detecting a state of an acoustic valve coupled to a balanced armature within a receiver. Aspects of the method include determining an impedance curve as a function of frequency through the balanced armature collapsed against one of two of permanent magnets, where the magnetic hysteresis curves of the two permanent magnets vary, comparing the determined impedance to known impedances for the balanced armature collapsed against each of the two permanent magnets, and determining a state of the acoustic valve based on the comparison.

Additional aspects of Embodiment G, and every other embodiment disclosed herein, further include energizing an electric coil of the balanced armature to change the state of the acoustic valve based on determining that the state is off.

Additional aspects of Embodiment G, and every other embodiment disclosed herein, further include the two permanent magnets having different magnetic hysteresis curves.

Additional aspects of the present disclosure will be apparent to those of ordinary skill in the art in view of the detailed description of various embodiments, which is made with reference to the drawings, and brief description of which is provided below.

BRIEF DESCRIPTION OF THE DRAWINGS

The present invention will now be described in further details with reference to the accompanying figures, wherein.

Figure 1A:
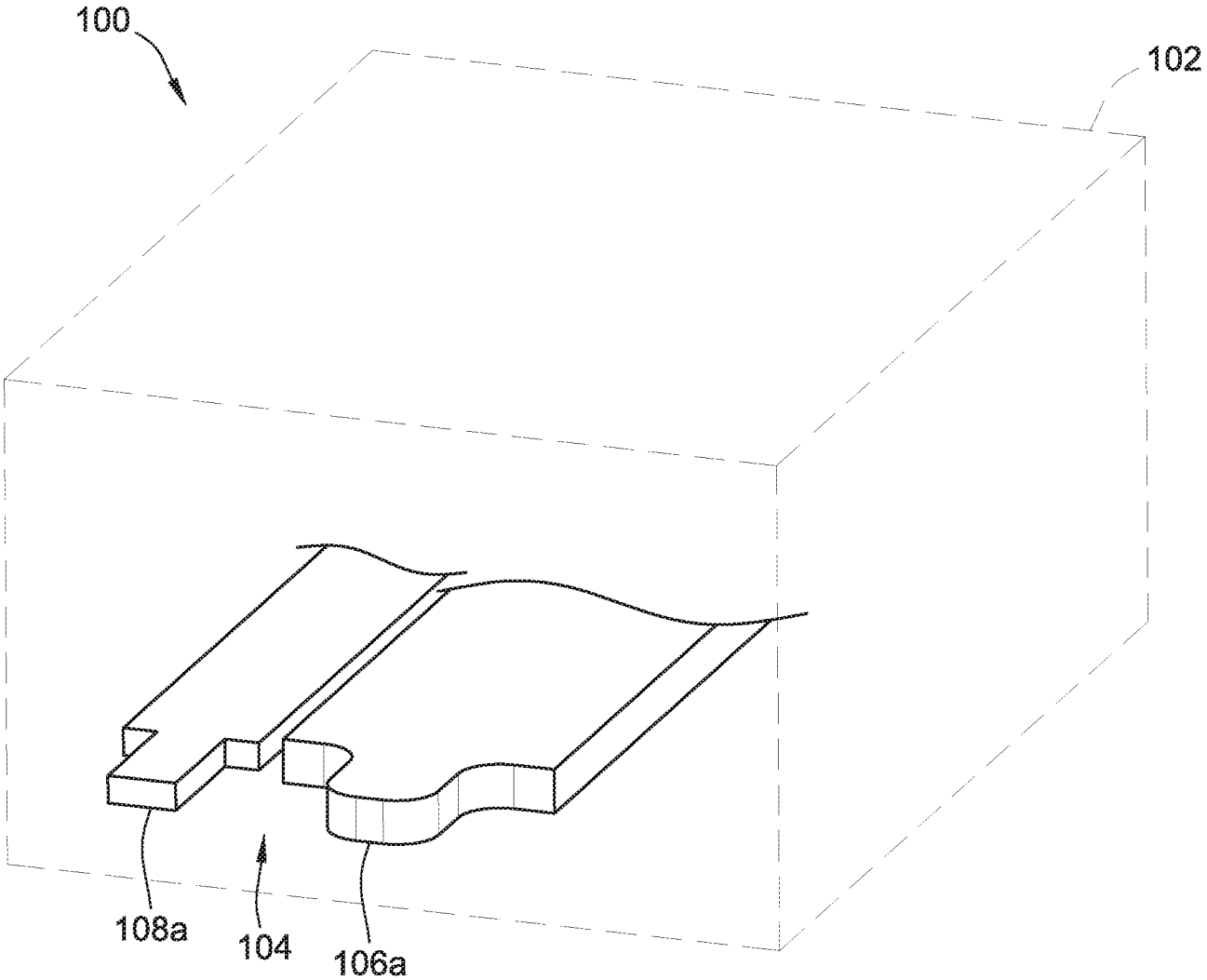
FIG. 1A shows a perspective view of components of a balanced armature receiver, in accord with aspects of the present disclosure.

While the apparatuses and methods discussed herein are susceptible to various modifications and alternative forms, specific embodiments have been shown by way of example in the drawings and will be described in detail herein. It should be understood, however, that the description is not intended to be limited to the particular forms disclosed. Rather, the description is to cover all modifications, equivalents, and alternatives falling within the spirit and scope of the present disclosure as defined by the appended claims.

DETAILED DESCRIPTION OF THE INVENTION

While the apparatuses discussed in the present disclosure are susceptible of embodiment in many different forms, there is shown in the drawings and will herein be described in detail preferred embodiments of the apparatuses with the understanding that the present disclosure is to be considered as an exemplification of the principles of the apparatuses and is not intended to limit the broad aspect of the apparatuses to the embodiments illustrated. For purposes of the present detailed description, the singular includes the plural and vice versa (unless specifically disclaimed); the word "or" shall be both conjunctive and disjunctive; the word "all" means "any and all"; the word "any" means "any and all"; and the word "including" means "including without limitation." Additionally, the singular terms "a," "an," and "the" include plural referents unless context clearly indicates otherwise.

FIG. 1 shows a perspective view of components of a balanced armature receiver 100, in accord with aspects of the present disclosure. The balanced armature receiver 100 includes a housing 102. The housing 102 can be various types of housings for acoustic devices. For example, the housing 102 can limit or reduce radio frequency interference, can provide shielding for the internal components, and can be formed of a high-strength material, such as high-strength aluminum or steel. Depending on the application of the housing 102, the housing 102 can be made with biocompatible materials, such housings for hearing aids and personal listening devices.

Within the housing 102 is a balanced armature assembly 104. The balanced armature assembly 104 includes an armature portion 106*a* and an armature portion 108*a*. The armature portions 106*a*, 108*a* can be portions of one or more generally U-shaped, generally E-shaped, or substantially flat armatures within of armature assembly 104. Moreover, the shape of the armatures of which the armature portions 106*a*, 108*a* are a part of may vary between each other. By way of example, and without limitation, the armature portion 106*a* may be of a generally U-shaped armature, and the armature portion 108*a* may be of a generally U-shaped, a generally E-shaped, or a substantially flat armature. Although shown as being separate, the armature portions 106*a*, 108*a* can be portions of the same armature of the armature assembly 104, or can be portions of two separate armatures of the armature assembly 104. In the configuration of two separate armatures within the armature assembly 104, the two separate armatures are mechanically, magnetically, and/or electrically associated and within the same immediate housing (e.g., housing 102) to constitute the single armature assembly 104.

The balanced armature receiver 100 and the armature portion 106*a* are configured mechanically, magnetically, or a combination thereof such that the armature portion 106*a* is stable in a balanced arrangement during operation of the balanced armature receiver 100. As discussed in detail below, the armature portion 106*a* is connected to a diaphragm (not shown) to generate acoustic signals of the balanced armature receiver 100.

The balanced armature receiver 100 and the armature portion 108*a* are configured mechanically, magnetically, or a combination thereof such that the armature portion 108*a* is unstable and in one of two bi-stable states in an unbalanced arrangement during operation of the balanced armature receiver 100. Thus, although the armature portion 108*a* is configured, in part, according to a balanced armature design, the armature portion 108*a* is configured to be unstable and within one of two bi-stable states to control one or more parts, and/or perform one or more functions, within the balanced armature receiver 100. Accordingly, the armature portion 108*a* collapses toward an upper or lower portion of the magnetic housing (not shown) and/or magnet stack (not shown) during operation, as discussed in greater detail below. Despite electrical current pulses sent to one or more electric drive coils (discussed below) associated with the armature portion 108*a*, the armature portion 108*a* remains unstable and in a bi-stable state (i.e., collapsed toward an upper or lower portion of the magnetic housing and/or magnet stack). Thus, magnetic flux generated by the electrical current pulses to the electric drive coils is insufficient to move the armature portion 108*a* from the current bi-stable state. However, in embodiments in which the armature portion 108*a* is associated with the same electric drive coils as the armature portion 106*a*, electrical current pulses can be sent to the same electric drive coils to drive the armature portion 106*a* to generate the acoustic signals while being insufficient to switch the armature portion 108*a* from the bi-stable state. Alternatively, different electric drive coils can be associated with the armature portions 106*a*, 108*a* to drive the armature portions 106*a*, 108*a* substantially independently, although the armature portions 106*a*, 108*a* are part of the same armature assembly 104 within the housing 102 of the balanced armature receiver 100.

Based on the armature portion 108*a* collapsing to an upper or lower portion, the armature portion 108*a* can be connected to one or more parts within the balanced armature receiver 100 to perform one or more functions substantially independently over control of the diaphragm by the armature portion 106*a*. By way of example, and without limitation, the armature portion 108*a* can be connected to an acoustic valve within the balanced armature receiver 100 to either close or open the acoustic valve. By closing or opening the acoustic valve, operation of the armature portion 108*a* switches the balanced armature receiver 100 between an open fitting and a closed fitting. Thus, the same armature assembly 104 can be used to both generate acoustic signals and to change the open/closed fitting of the balanced armature receiver 100.

Figure 1B:
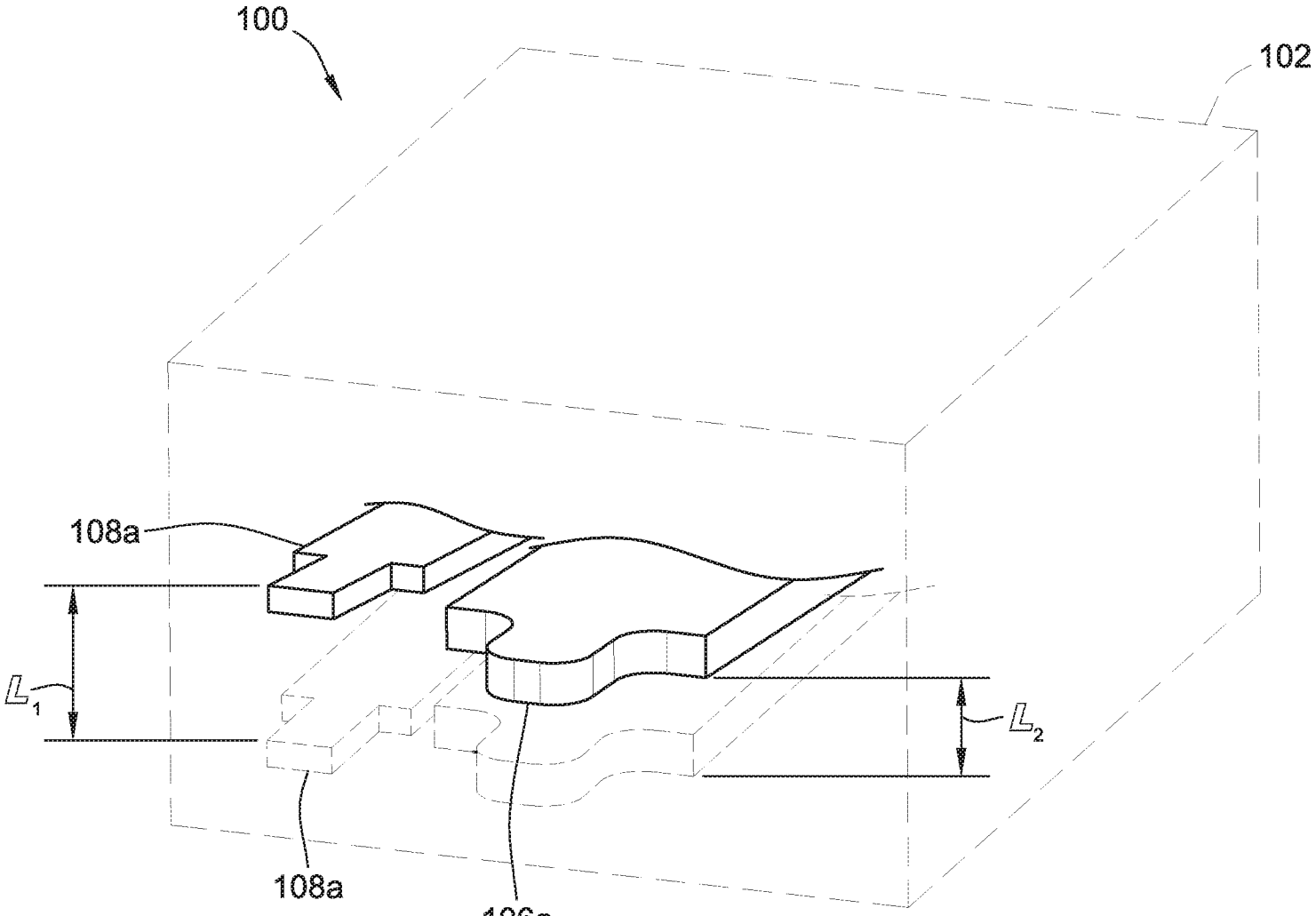
FIG. 1B shows an additional perspective view of components of a balanced armature receiver, including travel distances of armature portions, in accord with aspects of the present disclosure.

FIG. 1B shows one arrangement of the armature portions 106*a*, 108*a* within the armature assembly 104. Based on electrical current pulses sent through electric drive coils associated with the armature portions 106*a*, 108*a*, the armature portions 106*a*, 108*a* travel up and down. For example, the armature portion 108*a* travels the distance $L_1$ and the armature portion 106*a* travels the distance $L_2$ during operation of the balanced armature receiver 100. Based on one or more mechanical, electrical, and/or magnetic properties of the armature portion 106*a* relative to the armature portion 108*a*, or elements of the balanced armature receiver 100 for the armature portion 106*a* relative to the armature portion 108*a* (discussed in greater detail below), the armature portion 108*a* may be operated to remain unstable and in one bi-stable state (e.g., between the upper and lower extremes of the travel length $L_1$), while the armature portion 106*a* remains in a stable, balanced state between the upper and lower extremes of the travel length $L_2$. Accordingly, the armature portion 106*a* can drive a diaphragm to generate acoustic signals while the armature portion 108*a* controls another element or function within the balanced armature receiver 100.

Figure 1C:
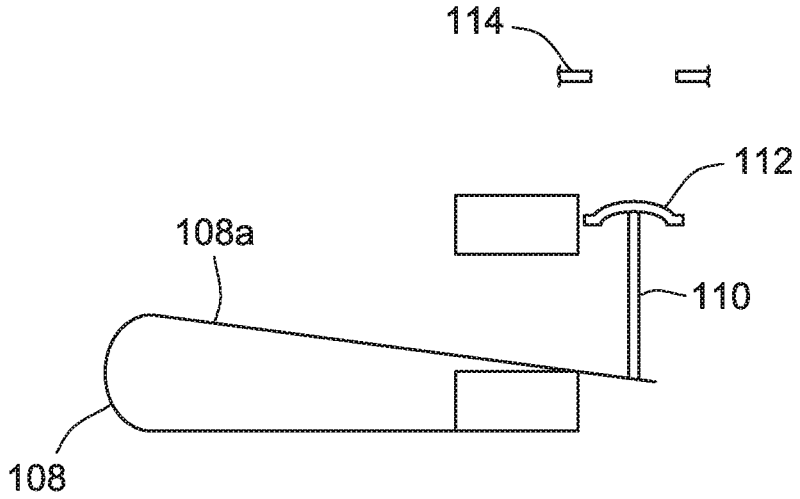
FIG. 1C shows an unstable state of an armature portion of a balanced armature receiver connected to an acoustic valve, in accord with aspects of the present disclosure.
Figure 1D:
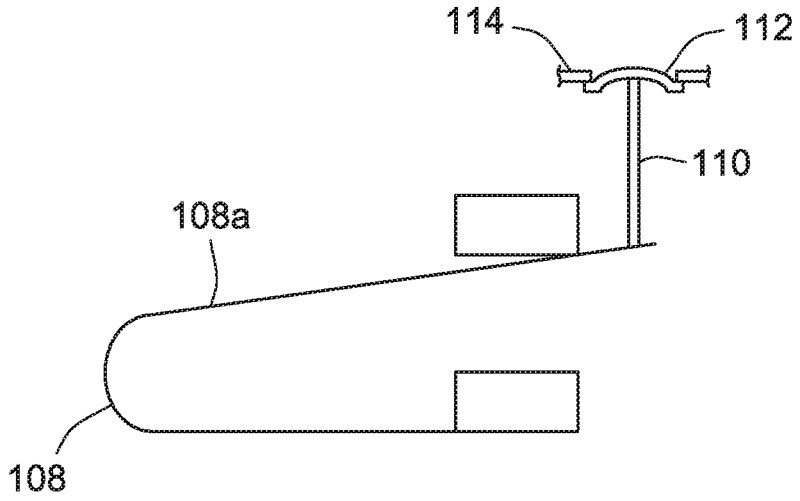
FIG. 1D shows another unstable state of the armature portion of a balanced armature receiver of FIG. 1C, in accord with aspects of the present disclosure.

Referring to FIGS. 1C and 1D, the armature portion 108*a* can be a portion of a generally U-shaped armature 108 that is connected to a drive rod 110. Opposite the armature portion 108*a*, the drive rod 110 is connected to a valve 112, such as an acoustic valve. The valve 112 may be configured to mate within an aperture 114. The aperture 114 may be within an acoustic pathway within the balanced armature receiver 100. Closing or opening the aperture 114 closes or opens the acoustic pathway and, therefore, switches the balanced armature receiver 100 between an open fitting and a closed fitting. According to some embodiments, the aperture is 0.5 to 10 millimeters squared ($mm^2$) to provide for an acoustic pathway that prevents, or at least reduces, occlusion.

FIG. 1C shows the armature portion 108*a* in a bi-stable state extending towards the lower extreme of the travel length $L_1$. Based on the armature portion 108*a* being connected to the valve 112 through the drive rod 110, the valve 112 is in a substantially open position. FIG. 1D shows the armature portion 108*a* in a bi-stable state extending towards the upper extreme of the travel length $L_1$. Based on the armature portion 108*a* being connected to the valve 112 through the drive rod 110, the valve 112 is in a substantially closed position. Based on the armature portion 108*a* being unstable and controlled in one of two bi-stable states, the armature portion 108*a* can control the position of the valve 112 and, therefore, the open or closed state of the aperture 114 to control whether the acoustic pathway is in a closed or open state. Moreover, because the armature portion 108*a* is part of the armature assembly 104, the armature portion 106*a* can continue controlling the diaphragm to generate acoustic signals substantially independent of the armature portion 108*a* while reducing the overall size of the balanced armature receiver with an active acoustic vent.

Figure 2:
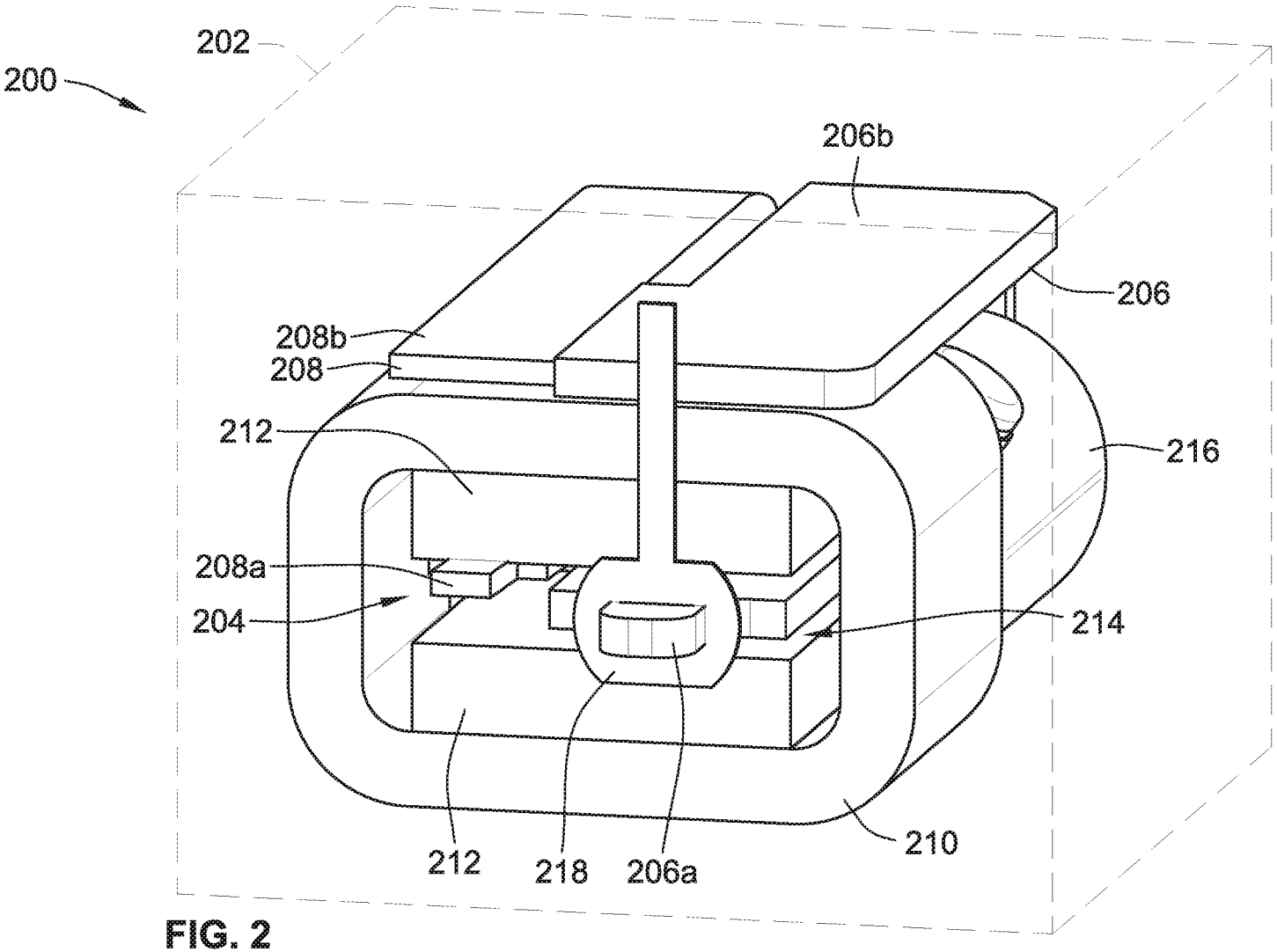
FIG. 2 shows a perspective view of a balanced armature receiver with a shared electric drive coil and magnet stack, in accord with aspects of the present disclosure.

FIG. 2 shows a perspective view of a balanced armature receiver 200 with a shared electric drive coil and magnet stack, in accord with aspects of the present disclosure. Similar to the balanced armature receiver 100, the balanced armature receiver 200 includes a housing 202, which is as described with respect to the housing 102. Within the housing 202 is an armature assembly 204. According to the specific arrangement of the balanced armature receiver 200, the armature assembly 204 includes armature portions 206*a*, 208*a*. The armature portions 206*a*, 208*a* are portions of two separate armatures of the armature assembly 204. Specifically, the armature portion 206*a* is the deflectable portion of the armature 206, and the armature portion 208*a* is the deflectable portion of the armature 208. However, alternatively, the armature portions 206*a*, 208*b* can be portions of the same armature. As shown, the armatures 206, 208 are generally U-shaped armatures, which further include fixed portions 206*b* and 208*b*.

The balanced armature receiver 200 further includes a magnetic housing 210. The distal ends of the armature portions 206*a*, 208*a* extend through the magnetic housing 210. The magnetic housing 210 includes a pair of magnets 212. Opposing surfaces of the pair of magnets 212 form a gap 214 through which the distal ends of the armature portions 206*a*, 208*a* extend.

The balanced armature receiver 200 further includes an electric drive coil 216. The electric drive coil 216 may be any conventional electric drive coil used within the field of balanced armatures. The electric drive coil 216 is formed of a winding of an electrically conductive material, such as copper. The diameter of the windings may be large enough to prevent or limit the effects of corrosion from the electric drive coils being in, for example, a corrosive environment, such as a biological environment (e.g., a user's ear). Alternatively, or in addition, the windings may be coated with a protective material, such as a parylene coating. The electric drive coil 216 forms a tunnel through which the armature portions 206*a*, 208*a* extend prior to extending through the gap 212.

The armature portion 206*a* includes a drive rod 218 that connects the armature portion 206*a* to a diaphragm (not shown) to generate the acoustic signals. The armature portion 208*a* includes a drive rod (not shown) that connects the armature portion 208*a* to an acoustic valve (not shown), discussed in greater detail below.

In operation, an electric current passes through the electric drive coil 216, which generates a magnetic field and magnetically energizes the armature portions 206*a*, 208*a*. Upon becoming magnetically energized, the armature portions 206*a*, 208*a* are magnetically attracted to one magnet of the pair of magnets 212. Based on the armature portions 206*a*, 208*a* sharing the electric drive coil 216 and the pair of permanent magnets 212, one or more mechanical and/or magnetic properties of the armature portion 208*a* is varied relative to the armature portion 206*a* so that the armature portion 208*a* is unstable and collapses a bi-stable state. The mechanical and magnetic properties may include, for example, the rigidity and magnetic permeability of the armature portions 206*a*, 208*a* relative to each other. Accordingly, during operation, the armature portion 208*a* is unstable relative to the armature portion 206*a* and collapses to a bi-stable state. The armature portion 208*a* collapses toward the upper or lower magnet of the pair of permanent magnets 212 and remains in the bi-stable state while the electric drive coil 216 drives the armature portion 206*a* to generate the acoustic signals.

Figure 3A:
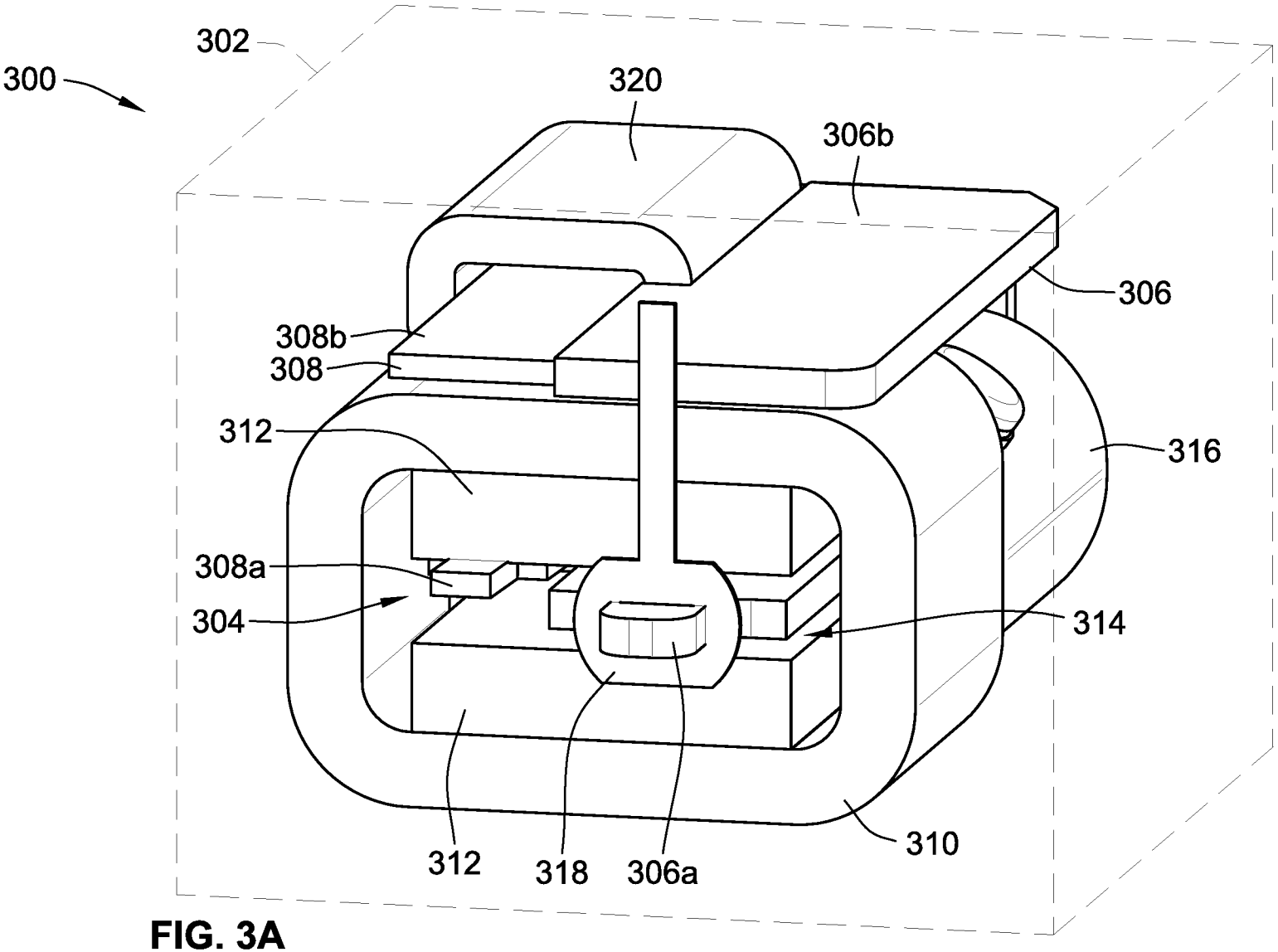
FIG. 3 shows a perspective view of a balanced armature receiver with a shared electric drive coil and magnet stack, and an additional electric drive coil, in accord with aspects of the present disclosure.
Figure 3B:
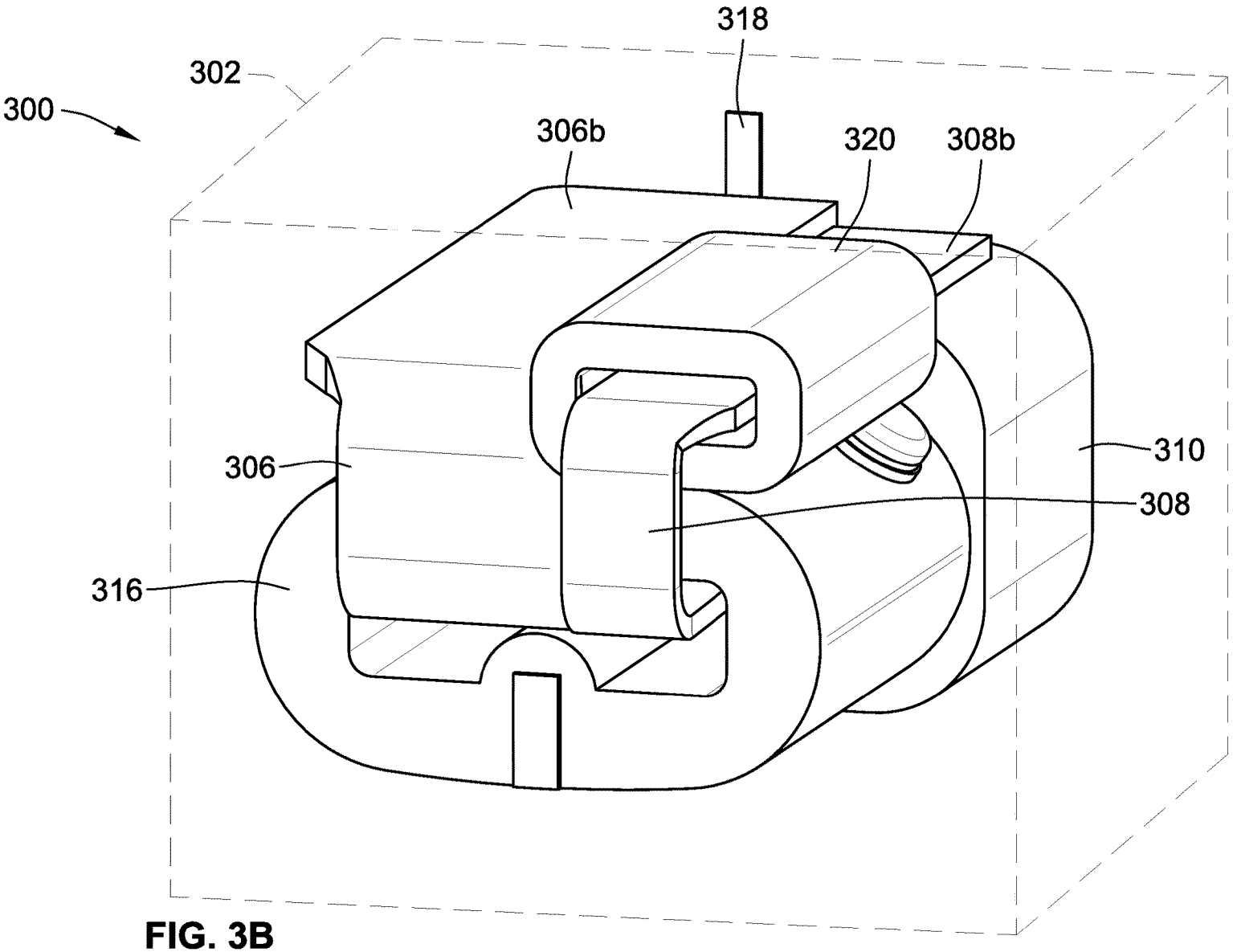

FIG. 3 shows a perspective view of a balanced armature receiver 300 with a shared electric drive coil and magnet stack, and an additional electric drive coil, in accord with aspects of the present disclosure. The balanced armature receiver 300 is similar to the balanced armature receiver 200 of FIG. 2. That is, the balanced armature receiver 300 includes a housing 302, which is as described with respect to the housing 102. Within the housing 302 is an armature assembly 304. According to the specific arrangement of the balanced armature receiver 300, the armature assembly 304 includes armature portions 306*a*, 308*a*. The armature portions 306*a*, 308*a* are portions of two separate armatures of the armature assembly 304. Specifically, the armature portion 306*a* is the deflectable portion of the armature 306, and the armature portion 308*a* is the deflectable portion of the armature 308. As shown, the armatures 306, 308 are generally U-shaped armatures, which further include fixed portions 306*b* and 308*b*. The fixed portions 306*b*, 308*b* are coupled to the housing 302 to fix the armature assembly 304 within the balanced armature receiver 300.

The balanced armature receiver 300 further includes a magnetic housing 310. The distal ends of the armature portions 306*a*, 308*a* extend through the magnetic housing 310. The magnetic housing 310 includes a pair of magnets 312. Opposing surfaces of the pair of magnets 312 form a gap 314 through which the distal ends of the armature portions 306*a*, 308*a* extend.

The balanced armature receiver 300 further includes an electric drive coil 316. The electric drive coil 316 may be any conventional electric drive coil used within the field of balanced armatures. The electric drive coil 316 is formed of a winding of an electrically conductive material, such as copper. The diameter of the windings may be large enough to prevent or limit the effects of corrosion from the electric drive coils being in, for example, a corrosive environment, such as a biological environment (e.g., a user's ear). Alternatively, or in addition, the windings may be coated with a protective material, such as a parylene coating. The electric drive coil 316 forms a tunnel through which the armature portions 306*a*, 308*a* extend prior to extending through the gap 312.

The armature portion 306*a* includes a drive rod 318 that connects the armature portion 306*a* to a diaphragm (not shown) to generate the acoustic signals. The armature portion 308*a* includes a drive rod (not shown) that connects the armature portion 308*a* to an acoustic valve (not shown), discussed in greater detail below.

The balanced armature receiver 300 further includes a drive coil 320. The electric drive coil 320 surrounds the fixed portion 308*b* of the armature 308. The electric drive coil 320 can be directly coupled to the fixed portion 308*b* of the armature 308. Alternatively, the electric drive coil 320 can be indirectly coupled to the fixed portion 308*b* of the armature 308, such as through both being coupled to the housing 302. The electric drive coil 320 can be formed and attached to the armature 308, such as being slid around the fixed portion 308*b* of the armature 308 after being formed. Alternatively, the electric drive coil 320 can be formed around the fixed portion 308. For example, the windings that form the electric drive coil 320 can be wound directly around the fixed armature 308*b*.

Although shown as surrounding the fixed portion 308*b* of the armature 308, alternatively, the electric drive coil 320 can surround the armature portion 308*a*, which is the moving portion of the armature 308*a*. In the context of balanced armature designs, typically the mass of the armature portion 308*a* is minimized to reduce the energy required to move the armature portion 308*a*. However, because the armature portion 308*a* is used to control the position of an acoustic valve, the mass of the armature portion 308*a* can be increased without negatively impacting its function, because the functionality of the armature portion 308*a* is to control the position of an acoustic valve.

In operation, an electric current passes through the electric drive coil 316, which generates a magnetic field and magnetically energizes the armature portions 306*a*, 308*a*. Upon becoming magnetically energized, the armature portions 306*a*, 308*a* are magnetically attracted to one magnet of the pair of magnets 312. Based on the armature portions 306*a*, 308*a* sharing the electric drive coil 316 and the pair of permanent magnets 312, one or more mechanical and/or magnetic properties of the armature portion 308*a* is varied relative to the armature portion 306*a* so that the armature portion 308*a* is unstable and collapses to a bi-stable state. The mechanical and magnetic properties may include, for example, the rigidity and magnetic permeability of the armature portions 306*a*, 308*a* relative to each other. Accordingly, during operation, the armature portion 308*a* is unstable relative to the armature portion 306*a* and collapses to a bi-stable state. The armature portion 308*a* collapses toward the upper or lower magnet of the pair of permanent magnets 312 and remains in the bi-stable state while the electric drive coil 316 drives the armature portion 306*a* to generate the acoustic signals. In addition, the presence of the electric drive coil 320 allows the armature portion 308*a* to be driven substantially independently of the electric drive coil 316. The electric drive coil 320 allows the bi-stable state of the armature portion 308*a* to be changed independently from an electric current pulse to the electric drive coil 316, which may otherwise detract from the acoustic signals generated by the armature portion 306*a*.

Figure 4:
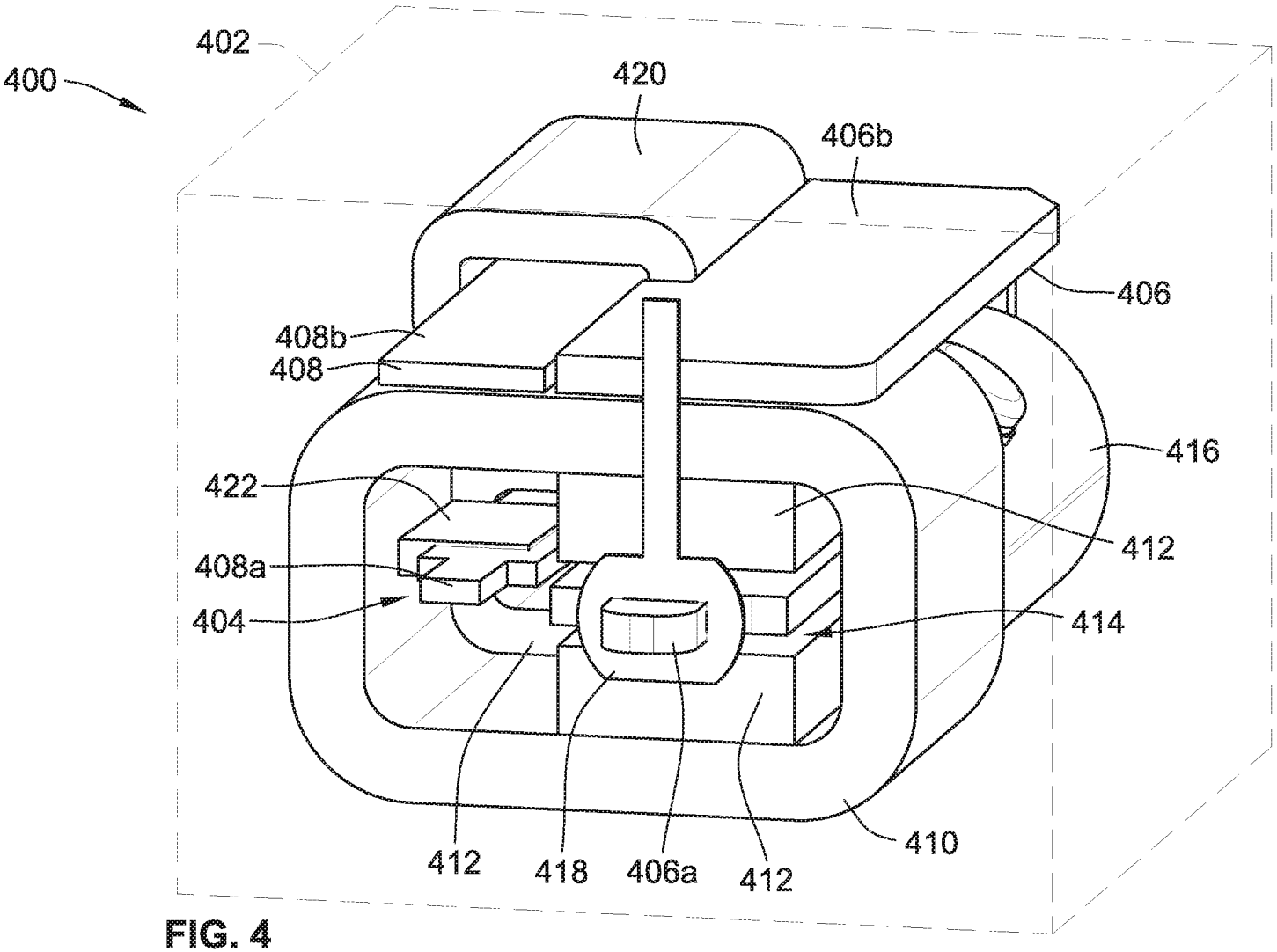
FIG. 4 shows a perspective view of a balanced armature receiver without a shared magnet stack, and a permanent magnet on an armature portion, in accord with aspects of the present disclosure.

FIG. 4 shows a perspective view of a balanced armature receiver 400 without a shared magnet stack, but with a permanent magnet on an armature portion, in accord with aspects of the present disclosure. Like the balanced armature receivers 200, 300, and as discussed above with respect to FIG. 1, the balanced armature receiver 400 includes a housing; though not shown for illustrative convenience. Within the housing is an armature assembly 404. According to the specific arrangement of the balanced armature receiver 400, the armature assembly 404 includes armature portions 406*a*, 408*a*. The armature portions 406*a*, 408*a* are portions of two separate armatures of the armature assembly 404. Specifically, the armature portion 406*a* is the deflectable portion of the armature 406, and the armature portion 408*a* is the deflectable portion of the armature 408. As shown, the armatures 406, 408 are generally U-shaped armatures, which further include fixed portions 406*b* and 408*b*. The fixed portions 406*b*, 408*b* are coupled to the housing 402 to fix the armature assembly 404 within the balanced armature receiver 400.

The balanced armature receiver 400 further includes a magnetic housing 410. The distal ends of the armature portions 406*a*, 408*a* extend through the magnetic housing 410. The magnetic housing 410 includes a pair of magnets 412. Opposing surfaces of the pair of magnets 412 form a gap 414 through which the distal end of the armature portion 406*a* extends. Thus, unlike the balanced armature receivers 200, 300, the armature portion 408*a* does not extend through the gap 414 between the pair of permanent magnets 412. Instead, a permanent magnet 422 is directly coupled to the distal end of the armature portion 408*a*. The permanent magnet 422 can be any type of magnet that provides enough magnetic flux to keep the armature portion 408*a* unstable and in a bi-stable state, collapsed toward the upper or lower portion of the magnetic housing 410. According to one embodiment, the permanent magnet 422 can be a rare earth magnet to, for example, reduce the size of the permanent magnet relative to a non-rare earth magnet.

Similar to the discussion above, in the context of balanced armature designs, typically the mass of the armature portion 408*a* would be minimized to reduce the energy required to move the armature portion 408*a*. Thus, one would typically not add mass to the armature portion 408*a* by adding the permanent magnet 422. However, because the armature portion 408*a* is used to control the position of an acoustic valve, the mass of the armature portion 408*a* can be increased without prohibiting the functionality of the armature portion 408*a* controlling acoustic valve.

The balanced armature receiver 400 further includes an electric drive coil 416. The electric drive coil 416 may be any conventional electric drive coil used within the field of balanced armatures. The electric drive coil 416 is formed of a winding of an electrically conductive material, such as copper. The diameter of the windings may be large enough to prevent or limit the effects of corrosion from the electric drive coils being in, for example, a corrosive environment, such as a biological environment (e.g., a user's ear). Alternatively, or in addition, the windings may be coated with a protective material, such as a parylene coating. The electric drive coil 416 forms a tunnel through which the armature portions 406*a*, 408*a* extend prior to extending through the gap 412.

The armature portion 406*a* includes a drive rod 418 that connects the armature portion 406*a* to a diaphragm (not shown) to generate the acoustic signals. The armature portion 408*a* includes a drive rod (not shown) that connects the armature portion 408*a* to an acoustic valve (not shown), discussed in greater detail below.

The balanced armature receiver 400 further includes a drive coil 420. The electric drive coil 420 surrounds the fixed portion 408*b* of the armature 408. Similar to the electric drive coil 320, the electric drive coil 420 can be directly coupled to the fixed portion 408*b* of the armature 408. Alternatively, the electric drive coil 420 can be indirectly coupled to the fixed portion 408*b* of the armature 408, such as through both being coupled to the housing 402. The electric drive coil 420 can be formed and attached to the armature 408, such as being slid around the fixed portion 408*b* of the armature 408 after being formed. Alternatively, the electric drive coil 420 can be formed around the fixed portion 408. For example, the windings that form the electric drive coil 420 can be wound directly around the fixed armature 408*b*. Although shown as surrounding the fixed portion 408*b* of the armature 408, alternatively, the electric drive coil 420 can surround the armature portion 408*a*, which is the moving portion of the armature 408*a*.

In operation, an electric current passes through the electric drive coil 416, which generates a magnetic field and magnetically energizes the armature portions 406*a*, 408*a*. Upon becoming magnetically energized, the armature portions 406*a*, 408*a* are magnetically attracted to one magnet of the pair of magnets 412 or to the corresponding portion of the magnetic housing 410. Based on the armature portions 406*a*, 408*a* sharing the electric drive coil 416, one or more mechanical and/or magnetic properties of the armature portion 408*a* is varied relative to the armature portion 406*a* so that the armature portion 308*a* is unstable and collapses to a bi-stable state. For this arrangement, the variation is, in part, the presence of the permanent magnet 422 coupled to the armature portion 408*a*. Accordingly, the armature portion 408*a* collapses toward the upper or lower portion of the magnetic housing 410 in the bi-stable state and remains in the bi-stable state while the electric drive coil 416 drives the armature portion 406*a* to generate the acoustic signals. In addition, the presence of the electric drive coil 420 allows the armature portion 408*a* to be driven substantially independently of the electric drive coil 416. The electric drive coil 420 allows the bi-stable state of the armature portion 408*a* to be changed independent from an electric current pulse to the electric drive coil 416, which may otherwise detract from the acoustic signals generated by the armature portion 406*a*.

Figure 5:
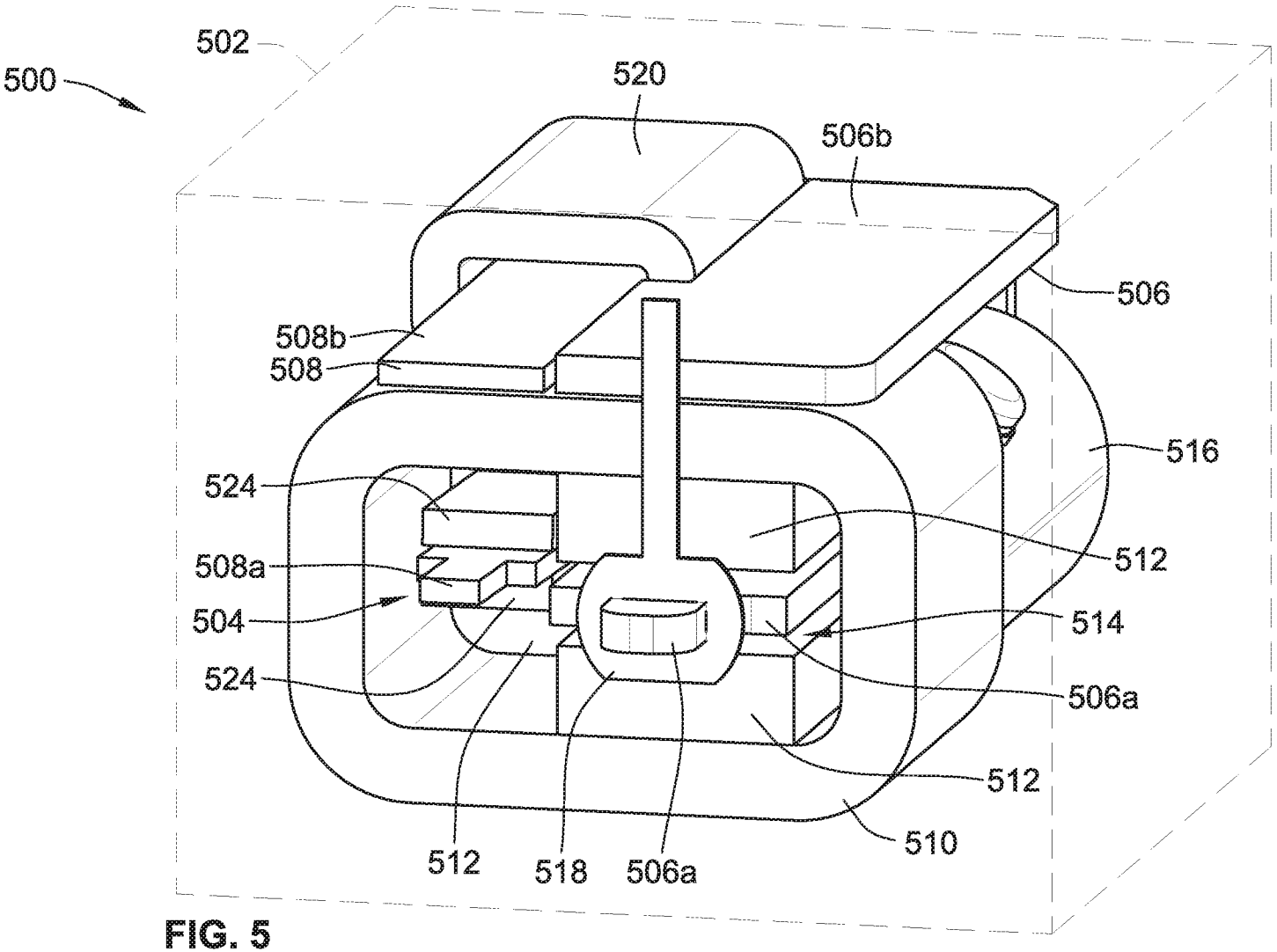
FIG. 5 shows a perspective view of a balanced armature receiver with a dual stack of magnets, in accord with aspects of the present disclosure.

FIG. 5 shows a perspective view of a balanced armature receiver 500 with a dual stack of magnets, in accord with aspects of the present disclosure. Like the balanced armature receivers 200-400, and as discussed above with respect to FIG. 1, the balanced armature receiver 500 includes a housing; though not shown for illustrative convenience. Within the housing is an armature assembly 504. According to the specific arrangement of the balanced armature receiver 500, the armature assembly 504 includes armature portions 506*a*, 508*a*. The armature portions 506*a*, portion 508*a* are portions of two separate armatures of the armature assembly 504. Specifically, the armature portion 506*a* is the deflectable portion of the armature 506, and the armature portion 508*a* is the deflectable portion of the armature 508. As shown, the armatures 506, 508 are generally U-shaped armatures, which further include fixed portions 506*b* and 508*b*. The fixed portions 506*b*, 508*b* are coupled to the housing 502 to fix the armature assembly 504 within the balanced armature receiver 500.

The balanced armature receiver 500 further includes a magnetic housing 510. The distal ends of the armature portions 506*a*, 508*a* extend through the magnetic housing 510. The magnetic housing 510 includes a pair of magnets 512. Opposing surfaces of the pair of magnets 512 form a gap 514 through which the distal end of the armature portion 506*a* extends. Thus, similar to the balanced armature receiver 400, the armature portion 508*a* does not extend through the gap 514 between the pair of permanent magnets 512. Instead, a pair magnets 524 is directly coupled to the distal end of the armature portion 508*a*, with one magnet of the pair of magnets 524 coupled to each side of the armature portion 508*a*. The permanent magnets 524 can be any type of magnet that provides enough magnetic flux to keep the armature portion 508*a* unstable and in a bi-stable state, collapsed toward the upper or lower portion of the magnetic housing 510. According to one embodiment, the permanent magnets 524 can be a rare earth magnets to, for example, reduce the size of the permanent magnets relative to a non-rare earth magnet.

Similar to the discussion above, in the context of balanced armature designs, typically the mass of the armature portion 508*a* would be minimized to reduce the energy required to move the armature portion 508*a*. Thus, one would typically not add mass to the armature portion 508*a* by adding the pair of permanent magnets 524. However, because the armature portion 508*a* is used to control the position of an acoustic valve, the mass of the armature portion 508*a* can be increased without prohibiting the functionality of the armature portion 508*a* controlling acoustic valve.

The balanced armature receiver 500 further includes an electric drive coil 516. The electric drive coil 516 may be any conventional electric drive coil used within the field of balanced armatures. The electric drive coil 516 is formed of a winding of an electrically conductive material, such as copper. The diameter of the windings may be large enough to prevent or limit the effects of corrosion from the electric drive coils being in, for example, a corrosive environment, such as a biological environment (e.g., a user's ear). Alternatively, or in addition, the windings may be coated with a protective material, such as a parylene coating. The electric drive coil 516 forms a tunnel through which the armature portions 506*a*, 508*a* extend prior to extending through the gap 514.

The armature portion 506*a* includes a drive rod 518 that connects the armature portion 506*a* to a diaphragm (not shown) to generate the acoustic signals. The armature portion 508*a* includes a drive rod (not shown) that connects the armature portion 508*a* to an acoustic valve (not shown), discussed in greater detail below.

The balanced armature receiver 500 further includes a drive coil 520. The electric drive coil 520 surrounds the fixed portion 508*b* of the armature 508. Similar to the electric drive coils 320, 420, the electric drive coil 520 can be directly coupled to the fixed portion 508*b* of the armature 508. Alternatively, the electric drive coil 520 can be indirectly coupled to the fixed portion 508*b* of the armature 508, such as through both being coupled to the housing 502. The electric drive coil 520 can be formed and attached to the armature 508, such as being slid around the fixed portion 508*b* of the armature 508 after being formed. Alternatively, the electric drive coil 520 can be formed around the fixed portion 508. For example, the windings that form the electric drive coil 520 can be wound directly around the fixed armature 508*b*. Although shown as surrounding the fixed portion 508*b* of the armature 508, alternatively, the electric drive coil 520 can surround the armature portion 508*a*, which is the moving portion of the armature 408*a*.

In operation, an electric current passes through the electric drive coil 516, which generates a magnetic field and magnetically energizes the armature portions 506*a*, 508*a*. Upon becoming magnetically energized, the armature portions 506*a*, 508*a* are magnetically attracted to one magnet of the pair of magnets 512 of the upper or lower portion of the magnetic housing 510. Based on the armature portions 506*a*, 508*a* sharing the electric drive coil 516, one or more mechanical and/or magnetic properties of the armature portion 508*a* is varied relative to the armature portion 506*a*. For this arrangement, the variation is, in part, the presence of the pair of permanent magnets 524 coupled to the armature portion 508*a*. Accordingly, the armature portion 508*a* collapses toward the upper or lower portion of the magnetic housing 510 in the bi-stable state and remains in the bi-stable state while the electric drive coil 516 drives the armature portion 506*a* to generate the acoustic signals. In addition, the presence of the electric drive coil 520 allows the armature portion 508*a* to be driven substantially independently of the electric drive coil 516. For example, the electric drive coil 520 allows the bi-stable state of the armature portion 508*a* to be changed independent from an electric current pulse from the electric drive coil 516, which may otherwise detract from the acoustic signals generated by the armature portion 506*a*.

Figure 6A:
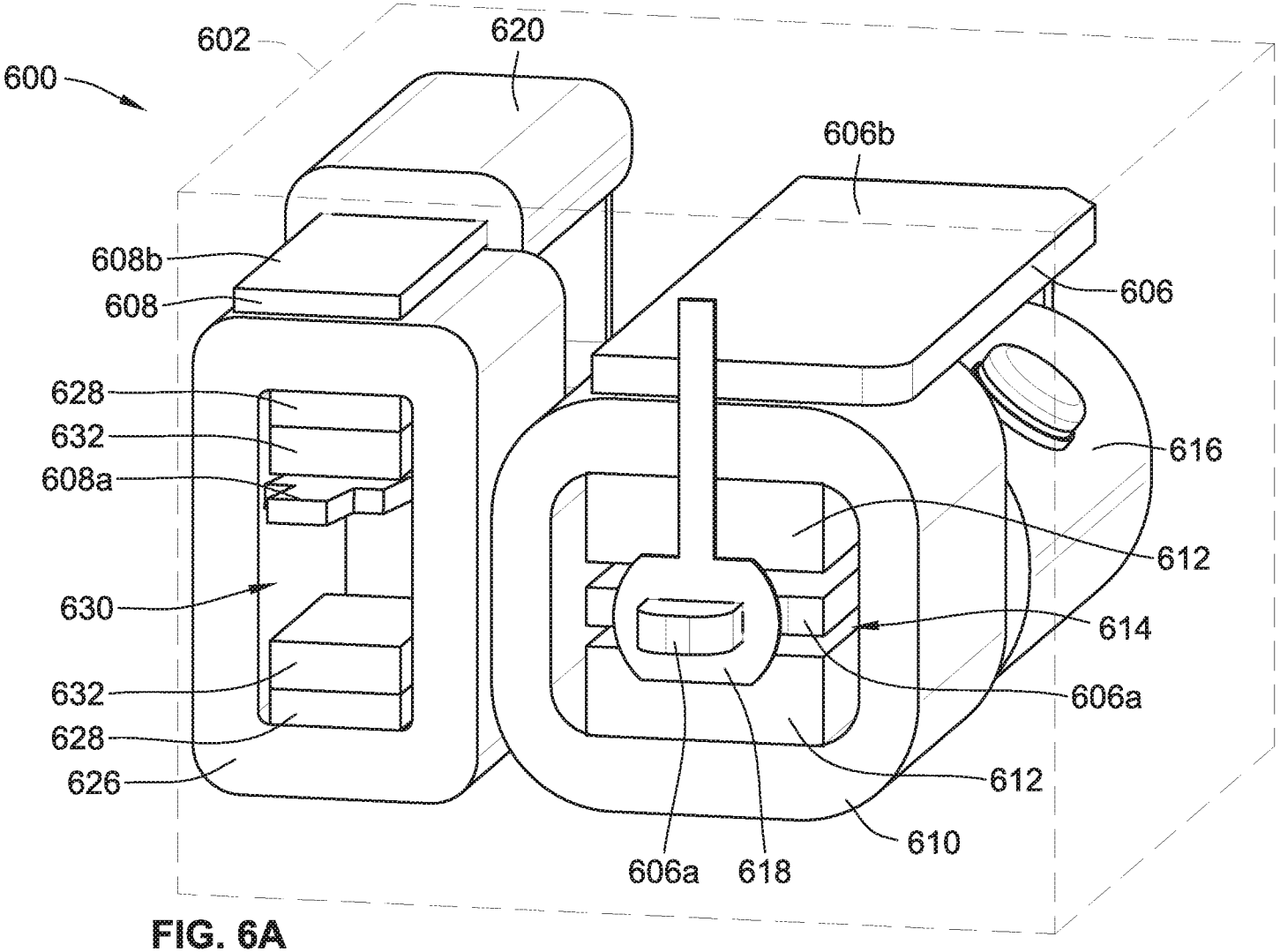
FIG. 6A shows a front perspective view of a balanced armature receiver with separate magnetic housings, in accord with aspects of the present disclosure.
Figure 6B:
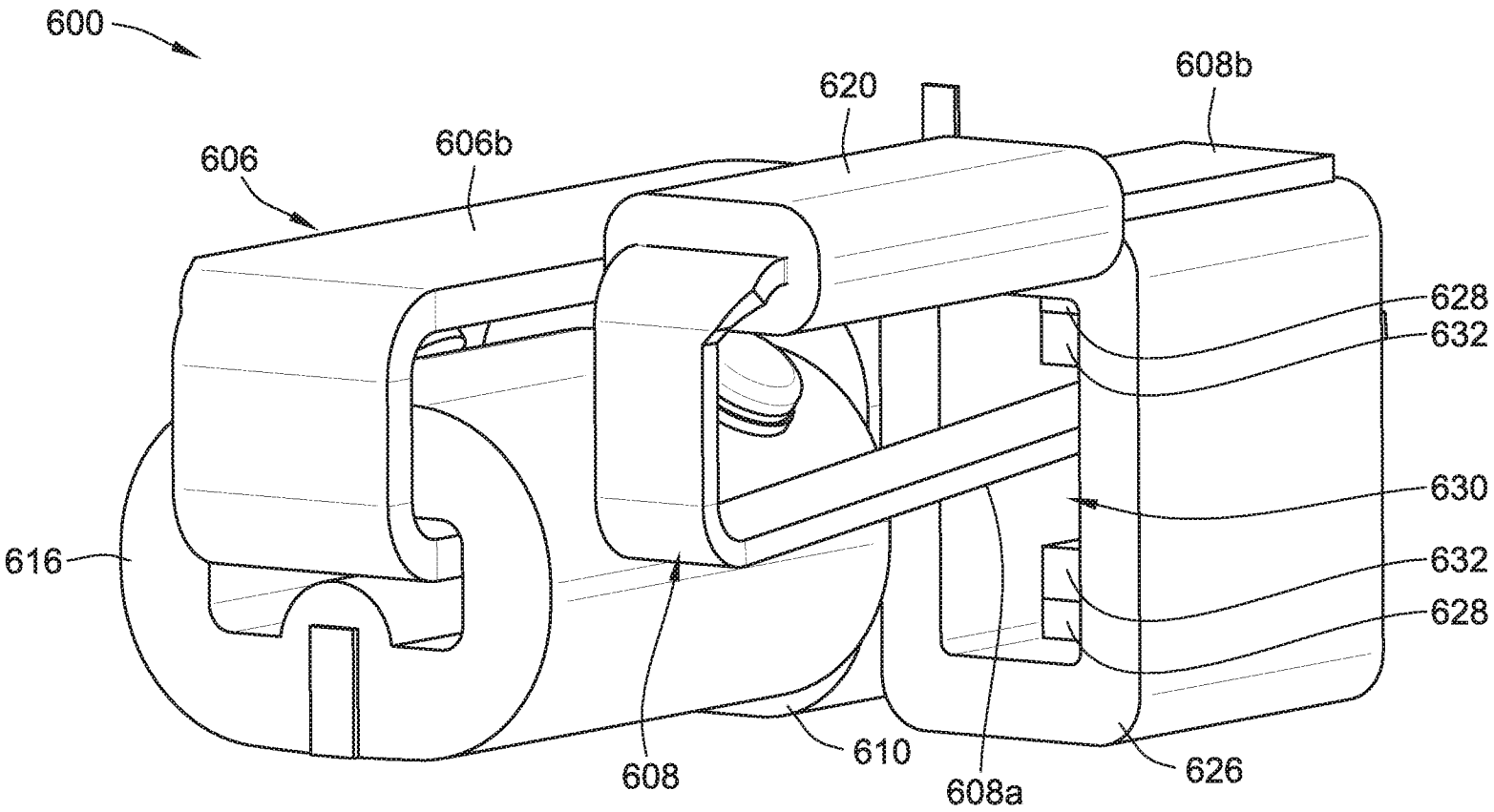
FIG. 6B shows a back perspective view of the balanced armature receiver of FIG. 6A, in accord with aspects of the present disclosure.

FIGS. 6A and 6B show perspective views from different perspectives of a balanced armature receiver 600 with separate magnetic housings, in accord with aspects of the present disclosure. Like the balanced armature receivers 200-500, and as discussed above with respect to FIG. 1, the balanced armature receiver 600 includes a housing; though not shown for illustrative convenience. Within the housing is an armature assembly 604. According to the specific arrangement of the balanced armature receiver 600, the armature assembly 604 includes armature portions 606*a*, 608*a*. The armature portions 606*a*, 608*a* are portions of two separate armatures of the armature assembly 604. Specifically, the armature portion 606*a* is the deflectable portion of the armature 606, and the armature portion 608*a* is the deflectable portion of the armature 608. As shown, the armatures 606, 608 are generally U-shaped armatures, which further include fixed portions 606*b* and 608*b*. The fixed portions 506*b*, 508*b* are coupled to the housing 502 to fix the armature assembly 504 within the balanced armature receiver 500.

The balanced armature receiver 600 further includes a magnetic housing 610 and a magnetic housing 626. The distal end of the armature portion 606*a* extends through the magnetic housing 610, and the distal end of the armature portion 608*a* extends through the magnetic housing 626. The magnetic housing 610 includes a pair of magnets 612. Opposing surfaces of the pair of magnets 612 form a gap 614 through which the distal end of the armature portion 506*a* extends. The magnetic housing 626 includes a pair of magnets 628. Opposing surfaces of the pair of magnets 628 form a gap 630 through which the distal end of the armature portion 608*a* extends. Thus, similar to the balanced armature receivers 400 and 500, the armature portion 608*a* does not extend through the gap 614 between the pair of permanent magnets 612. Instead, however, the armature portion 608*a* extends through the gap 630 between the pair of permanent magnets 628. The permanent magnets 628 can be any type of magnet that provides enough magnetic flux to keep the armature portion 608*a* unstable and collapsed toward the upper or lower portion of the magnetic housing 626. According to one embodiment, the permanent magnets 628 can be a rare earth magnet to, for example, reduce the size of the permanent magnets relative to a non-rare earth magnet.

The balanced armature receiver 600 optionally can include a pair of spacers 632. Each spacer 632 is coupled to a separate permanent magnet 628. The pair of spacers 632 limit the travel distance of the armature portion 608*a* required between unstable states, e.g., collapsed towards the upper or lower portion of the magnetic housing 626. Spacers of different sizes (e.g., lengths) can be placed on the permanent magnets 628 to control the travel distance of the armature portion 608*a*. Moreover, placement of the spacers 632 also reduces the magnetic force on the armature portion 608*a* from the permanent magnets 628 to reduce or control the restoring force or magnetic force required to actuate the armature portion 608*a* to the opposite bi-stable state. The spacers 632 can be formed of various substantially non-magnetic material(s), such as, for example, plastic, rubber, wood, brass, gold, silver, and the like, or combinations thereof.

Figure 6C:
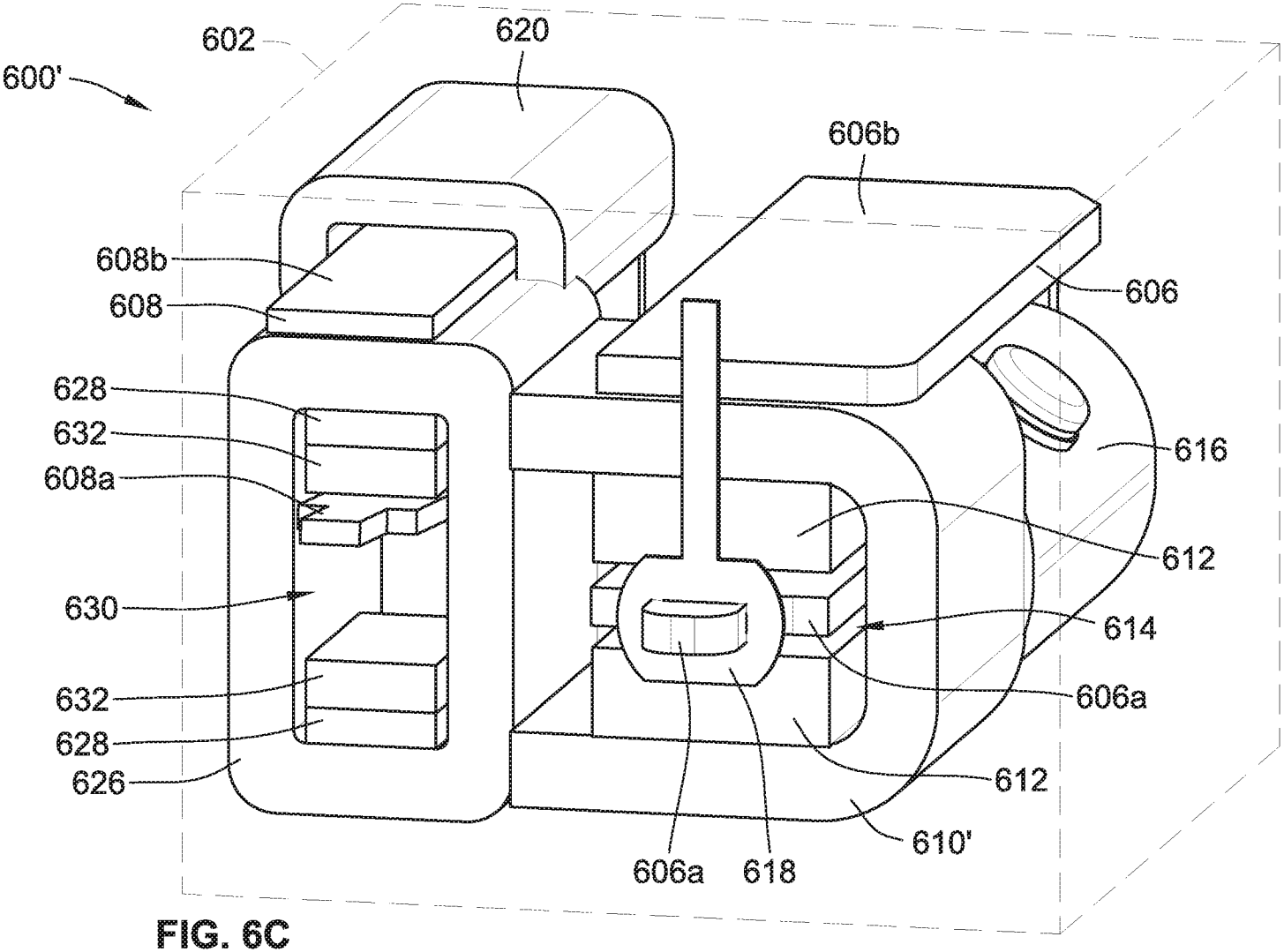
FIG. 6C shows a modified version of the balanced armature receiver of FIGS. 6A and 6B, in accord with aspects of the present disclosure.

FIG. 6C shows a perspective view of a balanced armature receiver 600', which is a modified version of the balanced armature receiver 600 of FIGS. 6A and 6B, in accord with aspects of the present disclosure. The elements of the balanced armature receiver 600' are the same as the balanced armature receiver 600, except for the magnetic housing 610'. To conserve space, the left side of the magnetic housing 610' is removed and the magnetic housing 610' is coupled to the right side of the magnetic housing 626. Alternatively, the magnetic housing 610' and the magnetic housing 626 can be formed as a solid, integral piece to form a single magnetic housing. By way of example, and without limitation, the single magnetic housing can be formed by metal injection molding.

Figure 6D:
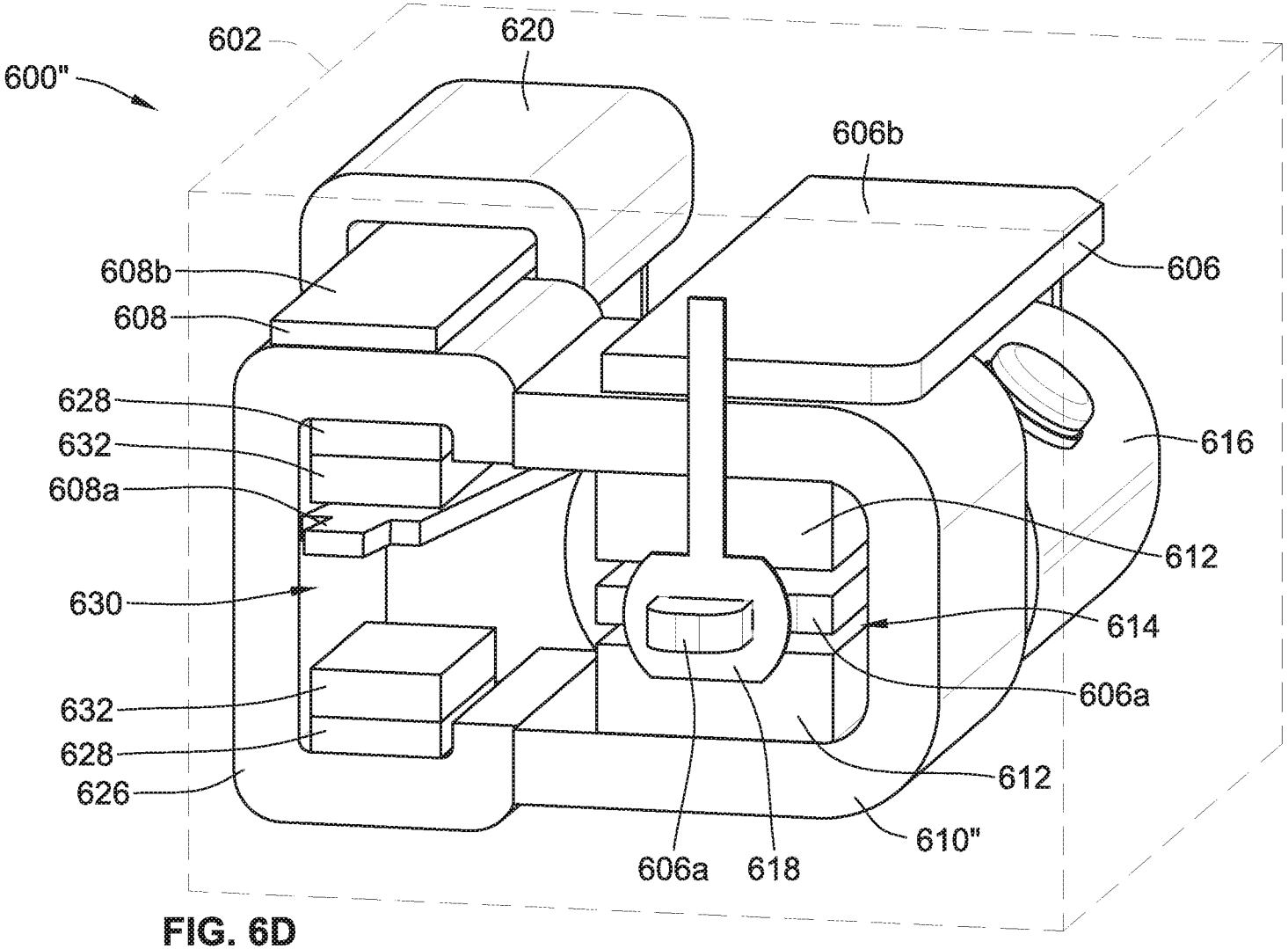
FIG. 6D shows another modified version of the balanced armature receiver of FIGS. 6A and 6B, in accord with aspects of the present disclosure.

FIG. 6D shows a perspective view of a balanced armature receiver 600", which is a modified version of the balanced armature receivers 600 and 600' of FIGS. 6A-6C, in accord with aspects of the present disclosure. The elements of the balanced armature receiver 600" are the same as the balanced armature receivers 600 and 600', except for the magnetic housings 610", 626". The right side of the magnetic housing 626 of the balanced armature receivers 600 and 600' is removed and the resulting magnetic housing 626" is coupled to the left side of the magnetic housing 610". Alternatively, the magnetic housing 610" and the magnetic housing 626" can be formed as a solid, integral piece to form a single magnetic housing. As described above, the single magnetic housing can be formed by metal injection molding.

Figure 6E:
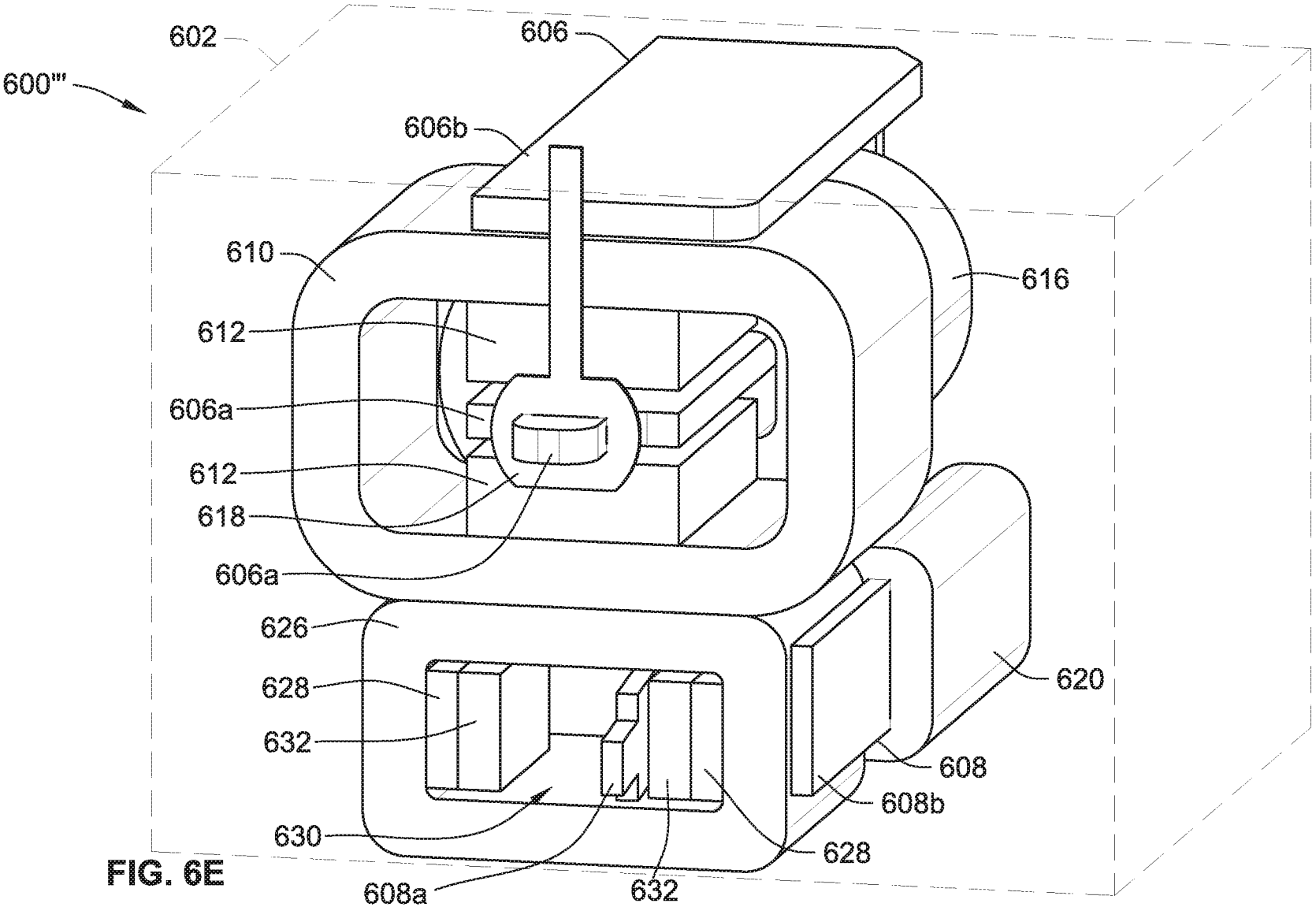
FIG. 6E shows an alternative arrangement of the balanced armature receiver of FIGS. 6A and 6B, in accord with aspects of the present disclosure.

FIG. 6E shows an alternative arrangement of the balanced armature receiver 600, in accord with aspects of the present concepts. Specifically, the components associated with the armature portion 608*a*, such as the magnetic housing 626, etc. can be oriented differently than the components associated with the armature portion 606*a*, such as the magnetic housing 610, etc. By way of example, and without limitation, the armature portion 608*a* can be rotated 90 degrees relative to the orientation of the armature portion 606*a*. Similarly, the travel direction of the armature portion 608*a* can be oriented differently than the travel direction of the armature portion 606*a*. Further, the travel direction and/or direction of movement required to actuate the acoustic valve can vary in any embodiment disclosed herein, such as being horizontal rather than vertical.

In operation, the presence of the electric drive coil 620 allows the armature portion 608*a* to be driven substantially independent of the electric drive coil 616. For example, the electric drive coil 620 allows the bi-stable state of the armature portion 608*a* to be changed independent from an electric current pulse from the electric drive coil 616 to generate the acoustic signals. Further, the presence of the pair of permanent magnets 624 coupled to the armature portion 608*a* allows the armature portion 608*a* to be unstable and in a bi-stable state relative to the armature portion 606*a*. In addition, one or more mechanical and/or magnetic properties of the armature portion 608*a* can be varied relative to the armature portion 606*a*. For example, although the armature portion 608*a* is substantially controlled by the electric drive coil 620, the rigidity of the armature portion 608*a* may be less than the rigidity of the armature portion 606*a*.

Figure 7:
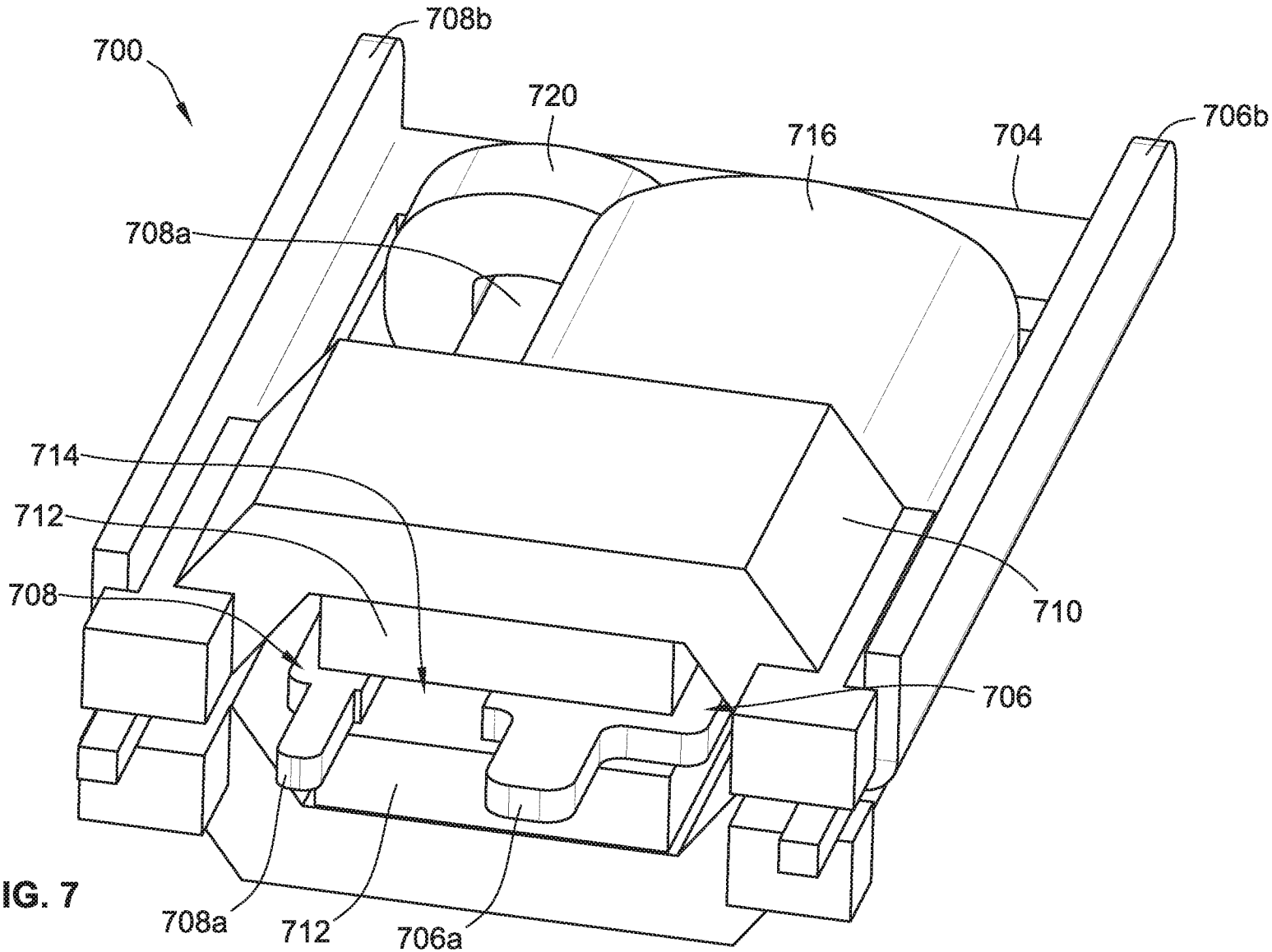
FIG. 7 shows a perspective view of a balanced armature receiver based on a generally E-shaped armature, in accord with aspects of the present disclosure.

FIG. 7 shows a perspective view of a balanced armature receiver 700 based on a generally E-shaped armature, in accord with aspects of the present disclosure. Like the balanced armature receivers 200-600", and as discussed above with respect to FIG. 1, the balanced armature receiver 700 includes a housing; though not shown for illustrative convenience. Within the housing is an armature assembly 704. According to the specific arrangement of the balanced armature receiver 700, the armature assembly 704 is a modified generally E-shaped armature. Instead of having one armature portion extending from the center, the armature assembly 704 has armature portions 706*a*, 708*a* extending from the center. Specifically, the armature portion 706*a* is a deflectable portion of the armature assembly 704, and the armature portion 708*a* is a deflectable portion of the armature assembly 704. The armature assembly 704 further includes fixed portions 706*b*, 708*b*. The fixed portions 706*b*, 708*b* are coupled to the housing to fix the armature assembly 704 within the balanced armature receiver 700.

The balanced armature receiver 700 further includes a magnetic housing 710. The distal ends of the armature portions 706*a*, 708*a* extend through the magnetic housing 710. The magnetic housing 710 includes a pair of permanent magnets 712. Opposing surfaces of the pair of permanent magnets 712 form a gap 714 through which the distal ends of the armature portions 706*a*, 708*a* extend.

The balanced armature receiver 700 further includes an electric drive coil 716. The electric drive coil 716 may be any conventional electric drive coil used within the field of balanced armatures. The electric drive coil 716 is formed of a winding of an electrically conductive material, such as copper. The diameter of the windings may be large enough to prevent or limit the effects of corrosion from the electric drive coils being in, for example, a corrosive environment, such as a biological environment (e.g., a user's ear). Alternatively, or in addition, the windings may be coated with a protective material, such as a parylene coating. The electric drive coil 716 forms a tunnel through which the armature portions 706*a*, 708*a* extend prior to extending through the gap 712.

The armature portion 706*a* includes a drive rod 718 (not shown) that connects the armature portion 706*a* to a diaphragm (not shown) to generate the acoustic signals. The armature portion 708*a* includes a drive rod (not shown) that connects the armature portion 708*a* to an acoustic valve (not shown), discussed in greater detail below.

The balanced armature receiver 700 further includes a drive coil 720. Unlike, for example, what is shown for the electric drive coil 320, the electric drive coil 720 surrounds the armature portion 308*a* (e.g., the moveable or deflectable portion). The electric drive coil 720 can be directly coupled to the armature portion 708*a*. Alternatively, the electric drive coil 720 can be indirectly coupled to the armature portion 708*a*, such as through both being coupled to the armature assembly 704.

In operation, the presence of the electric drive coil 720 allows the armature portion 708*a* to be driven substantially independent of the electric drive coil 716. For example, the electric drive coil 720 allows the bi-stable state of the armature portion 708*a* to be changed independently from an electric current pulse to the electric drive coil 716 to generate the acoustic signals. In addition, one or more mechanical and/or magnetic properties of the armature portion 708*a* can be varied relative to the armature portion 706*a*. For example, although the armature portion 708*a* is substantially controlled by the electric drive coil 720, the rigidity of the armature portion 708*a* may be less than the rigidity of the armature portion 706*a*.

Figure 8:
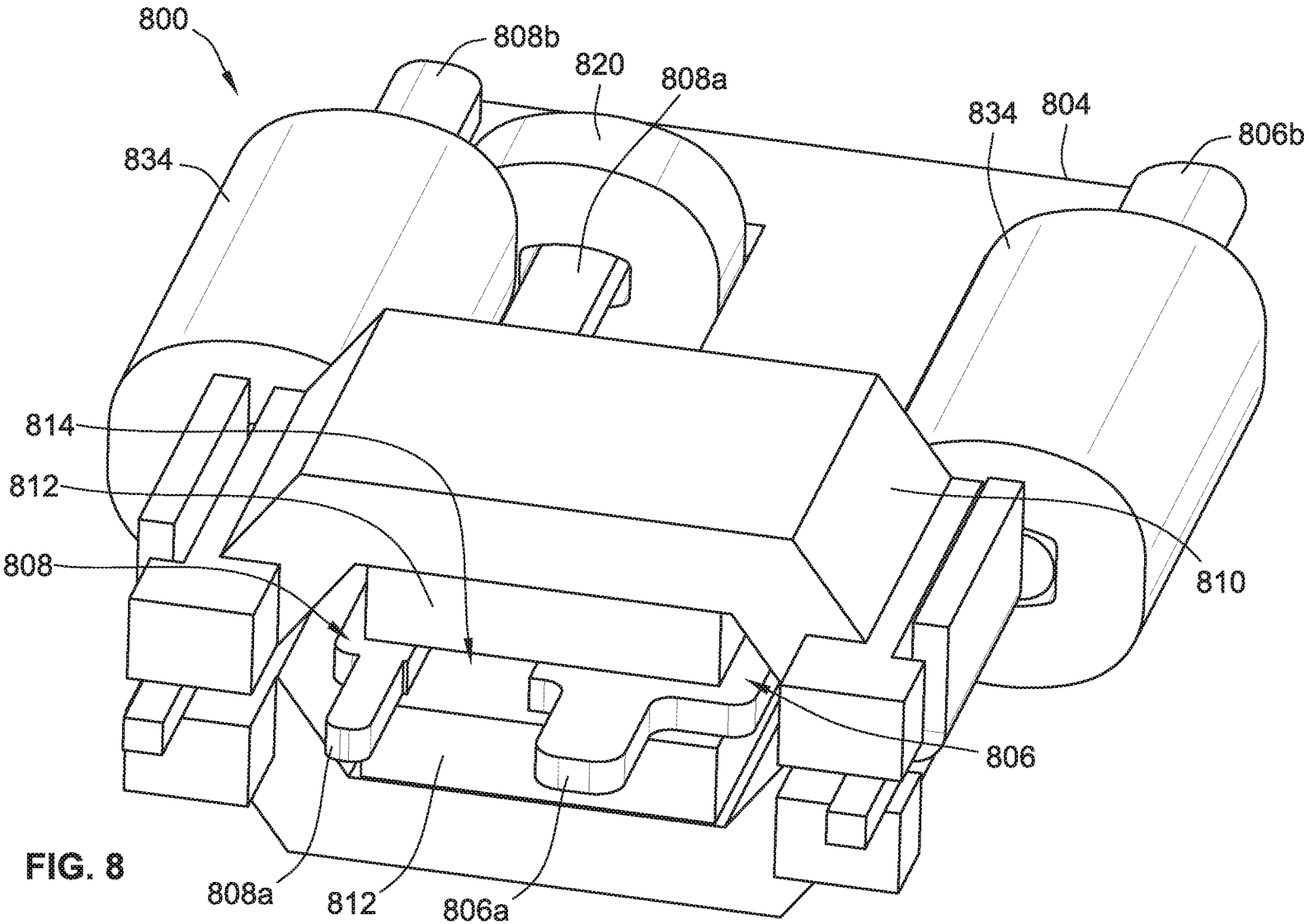
FIG. 8 shows a perspective view of a balanced armature receiver based on a generally E-shaped armature with three electric drive coils, in accord with aspects of the present disclosure.

FIG. 8 shows a perspective view of a balanced armature receiver 800 based on a generally E-shaped armature with three electric drive coils, in accord with aspects of the present disclosure. Like the balanced armature receivers 200-700, and as discussed above with respect to FIG. 1, the balanced armature receiver 800 includes a housing; though not shown for illustrative convenience. Within the housing is an armature assembly 804. According to the specific arrangement of the balanced armature receiver 800, the armature assembly 804 is a modified generally E-shaped armature. Instead of having one armature portion extending from the center, the armature assembly 804 has armature portions 806*a*, 808*a* extending from the center. Specifically, the armature portion 806*a* is a deflectable portion of the armature assembly 804, and the armature portion 808*a* is a deflectable portion of the armature assembly 804. The armature assembly 804 further includes fixed portions 806*b*, 808*b*. The fixed portions 806*b*, 808*b* are coupled to the housing to fix the armature assembly 804 within the balanced armature receiver 800.

The balanced armature receiver 800 further includes a magnetic housing 810. The distal ends of the armature portions 806*a*, 808*a* extend through the magnetic housing 810. The magnetic housing 810 includes a pair of permanent magnets 812. Opposing surfaces of the pair of permanent magnets 812 form a gap 814 through which the distal ends of the armature portions 806*a*, 808*a* extend.

The balanced armature receiver 800 further includes a pair of electric drive coils 834 that surround the fixed armature portions 806*b*, 806*b*. The electric drive coils 834 surround the non-movable fixed armature portions 806*b*, 808*b* rather than the deflectable armature portions 806*a*, 808*a*. The electric drive coils 834 can be coupled directly to the armature portions 806*b*, 808*b*. Alternatively, the electric drive coils 834 can be coupled indirectly to the armature portions 806*b*, 808*b*, such as by both being coupled to the housing.

The armature portion 806*a* includes a drive rod (not shown) that connects the armature portion 806*a* to a diaphragm (not shown) to generate the acoustic signals. The armature portion 808*a* includes a drive rod (not shown) that connects the armature portion 808*a* to an acoustic valve (not shown), discussed in greater detail below.

The balanced armature receiver 800 further includes a drive coil 820. Unlike, for example, what is shown for the electric drive coil 320, the electric drive coil 820 surrounds the armature portion 808*a* (e.g., the moveable or deflectable portion). The electric drive coil 820 can be directly coupled to the armature portion 808*a*. Alternatively, the electric drive coil 820 can be indirectly coupled to the armature portion 808*a*, such as through both being coupled to the housing.

In operation, the presence of the electric drive coil 820 allows the armature portion 708*a* to be driven substantially independent of the electric drive coils 834. For example, the electric drive coil 820 allows the bi-stable state of the armature portion 808*a* to be changed independent from an electric current pulse from the electric drive coils 834 to generate the acoustic signals.

Figure 9A:
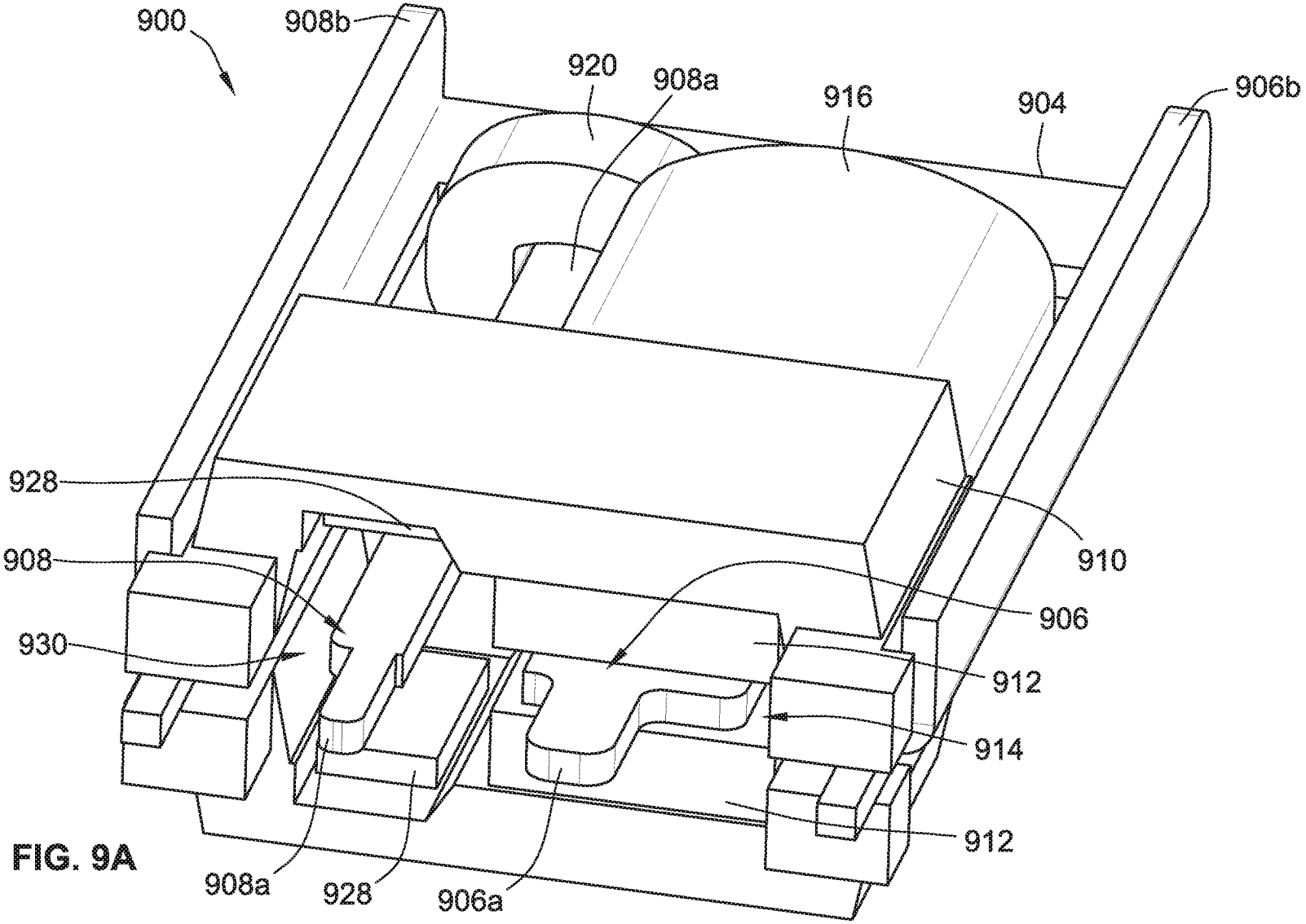
FIG. 9A shows a perspective view of a balanced armature receiver based on a generally E-shaped armature with two magnet stacks, in accord with aspects of the present disclosure.

FIG. 9A shows perspective view of a balanced armature receiver 900 based on a generally E-shaped armature with two magnet stacks, in accord with aspects of the present disclosure. Like the balanced armature receivers 200-800, and as discussed above with respect to FIG. 1, the balanced armature receiver 900 includes a housing; though not shown for illustrative convenience. Within the housing is an armature assembly 904. According to the specific arrangement of the balanced armature receiver 900, the armature assembly 904 is a modified generally E-shaped armature. Instead of having one armature portion extending from the center, the armature assembly 904 has armature portions 906*a*, 908*a* extending from the center. Specifically, the armature portion 906*a* is a deflectable portion of the armature assembly 904, and the armature portion 908*a* is a deflectable portion of the armature assembly 904. The armature assembly 904 further includes fixed portions 906*b*, 908*b*. The fixed portions 906*b*, 908*b* are coupled to the housing to fix the armature assembly 904 within the balanced armature receiver 900.

The balanced armature receiver 900 further includes a magnetic housing 910. The distal ends of the armature portions 906*a*, 908*a* extend through the magnetic housing 910. The magnetic housing 910 includes two pairs of permanent magnets 912, 928. Opposing surfaces of the pair of permanent magnets 912 form a gap 914 through which the distal end of the armature portion 806*a* extends. Opposing surfaces of the pair of permanent magnets 928 form a gap 930 through which the distal end of the armature portion 908*a* extends. The permanent magnets 928 can be any type of magnet that provides enough magnetic flux to keep the armature portion 908*a* unstable and collapsed toward the upper or lower portion of the magnetic housing 910. According to one embodiment, the permanent magnets 928 can be a rare earth magnet to, for example, reduce the size of the permanent magnets relative to a non-rare earth magnet. Although not shown, the balanced armature receiver 900 can further include a pair of spacers, such as the spacers 632.

The balanced armature receiver 900 further includes an electric drive coil 916. The electric drive coil 916 forms a tunnel through which the armature portion 906*a* extends prior to extending through the gap 514. The balanced armature receiver 900 further includes a drive coil 920. Unlike, for example, what is shown for the electric drive coil 320, the electric drive coil 920 surrounds the armature portion 808*a* (e.g., the moveable or deflectable portion). The electric drive coil 920 can be directly coupled to the armature portion 908*a*. Alternatively, the electric drive coil 920 can be indirectly coupled to the armature portion 908*a*, such as through both being coupled to the housing.

The armature portion 906*a* includes a drive rod (not shown) that connects the armature portion 906*a* to a diaphragm (not shown) to generate the acoustic signals. The armature portion 908*a* includes a drive rod (not shown) that connects the armature portion 908*a* to an acoustic valve (not shown), discussed in greater detail below.

Figure 9B:
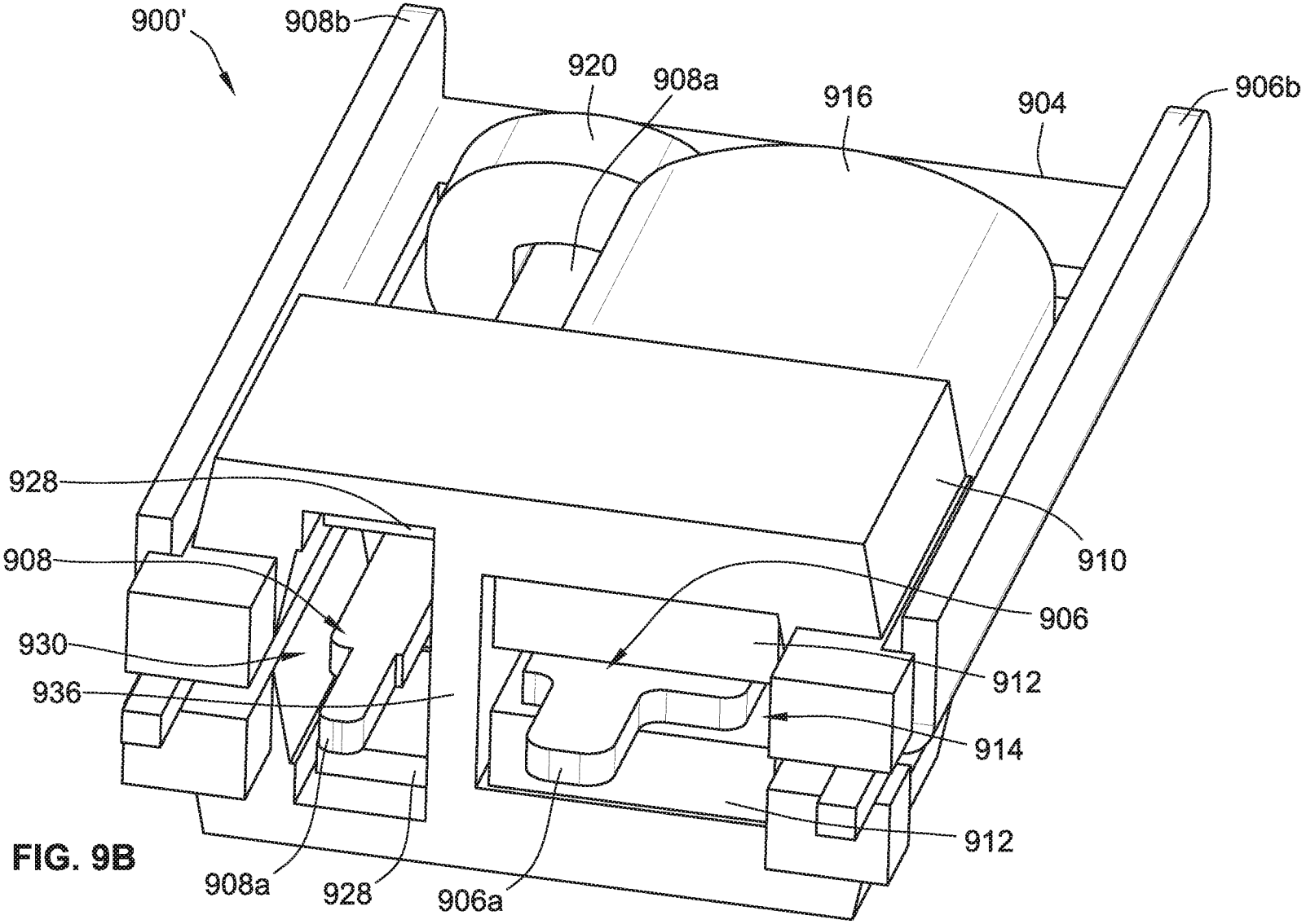
FIG. 9B shows a perspective view of a modified version of the balanced armature receiver of FIG. 9A, in accord with aspects of the present disclosure.

FIG. 9B shows a perspective view of a balanced armature receiver 900', which is a modified version of the balanced armature receiver 900 of FIG. 9A, in accord with aspects of the present disclosure. The elements of the balanced armature receiver 900' are the same as the balanced armature receiver 900, except for the magnetic housing 910'. To further divide the armatures portions 906*a*, 908*a* and/or provide structural support or rigidity, the magnetic housing 910' includes a column 936.

Figure 9C:
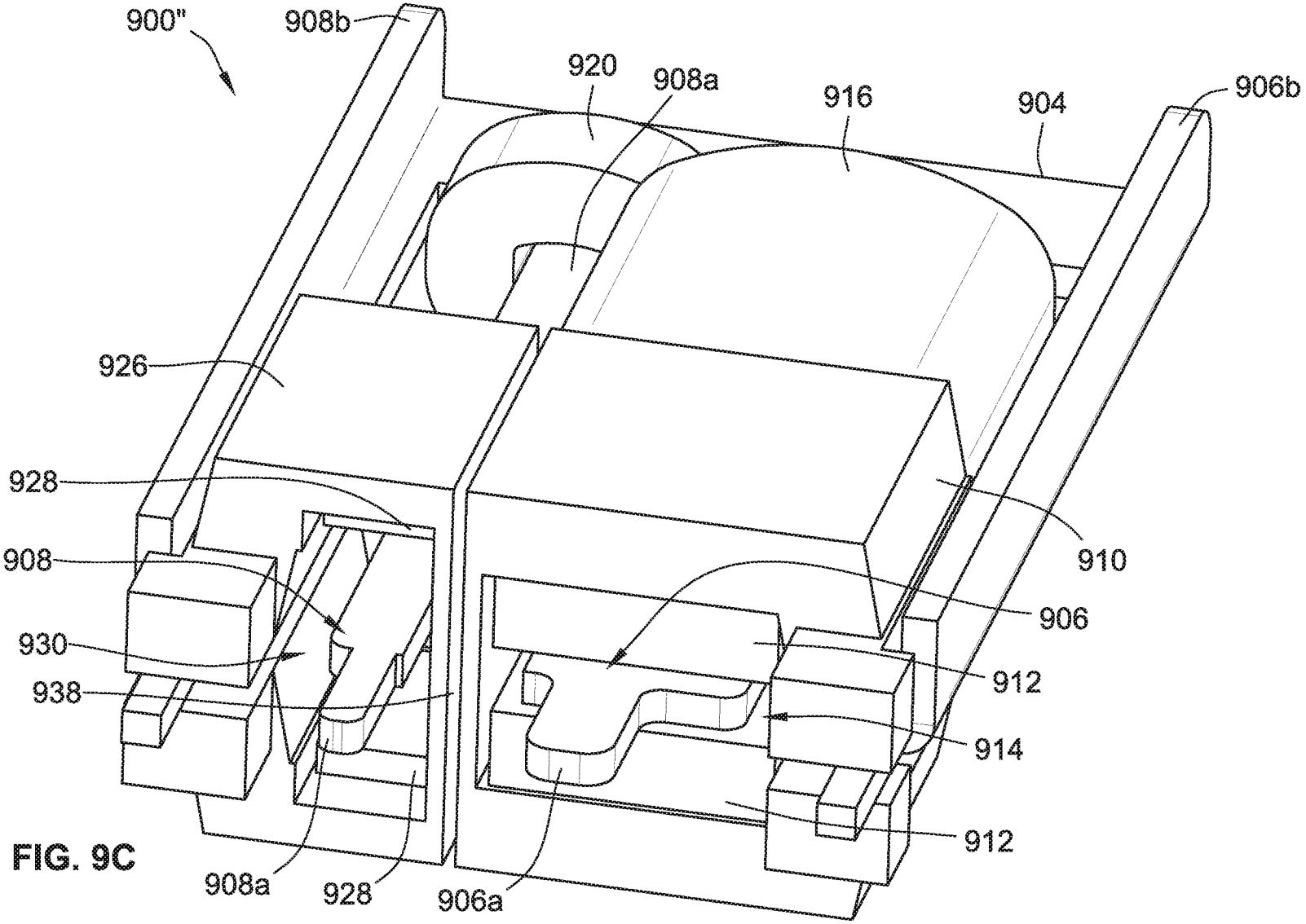
FIG. 9C shows a perspective view of another modified version of the balanced armature receiver of FIG. 9A, in accord with aspects of the present disclosure.

FIG. 9C shows a perspective view of a balanced armature receiver 900", which is a modified version of the balanced armature receivers 900' of FIGS. 9A and 9B, in accord with aspects of the present disclosure. The elements of the balanced armature receiver 900" are the same as the balanced armature receiver 900, except for the magnetic housing 910" and the magnetic housing 926. Rather than having a single magnetic housing, the balanced armature receiver 900" includes two magnetic housings. The magnetic housing 910" holds the pair of permanent magnets 912. The magnetic housing 926 holds the pair of permanent magnets 928. A gap 938 is between the magnetic housings 910", 926. The gap 938 can be filled with a material to insulate (thermally, electrically, magnetically, and/or mechanically) the armature portion 906*a* from the armature portion 908*a*.

In operation, the presence of the electric drive coil 920 allows the armature portion 908*a* to be driven substantially independent of the electric drive coil 916. For example, the electric drive coil 920 allows the bi-stable state of the armature portion 908*a* to be changed independent from an electric current pulse from the electric drive coil 916 to generate the acoustic signals. Further, the presence of the pair of permanent magnets 928 (and potentially spacers 932) coupled to the magnetic housing 910 (or magnetic housing 926) allows the armature portion 908*a* to be unstable and in a bi-stable state relative to the armature portion 906*a*. In addition, and according to all of the embodiments discussed herein, one or more mechanical and/or magnetic properties of the armature portion 908*a* can be varied relative to the armature portion 906*a*. For example, although the armature portion 908*a* is substantially controlled by the electric drive coil 920, the rigidity of the armature portion 908*a* may be less than the rigidity of the armature portion 906*a*.

Figure 10A:
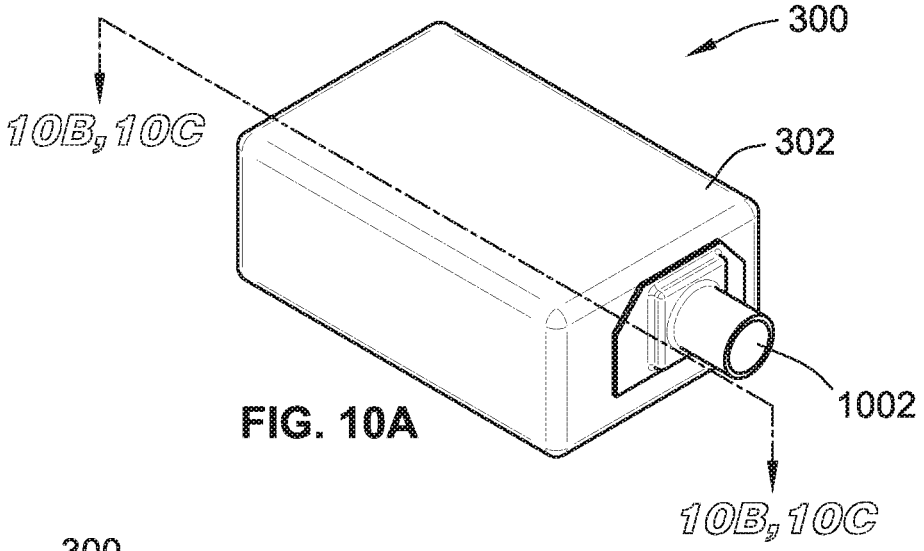
FIG. 10A shows a perspective view of the exterior of the housing of a balanced armature receiver, in accord with aspects of the present disclosure.
Figure 10B:
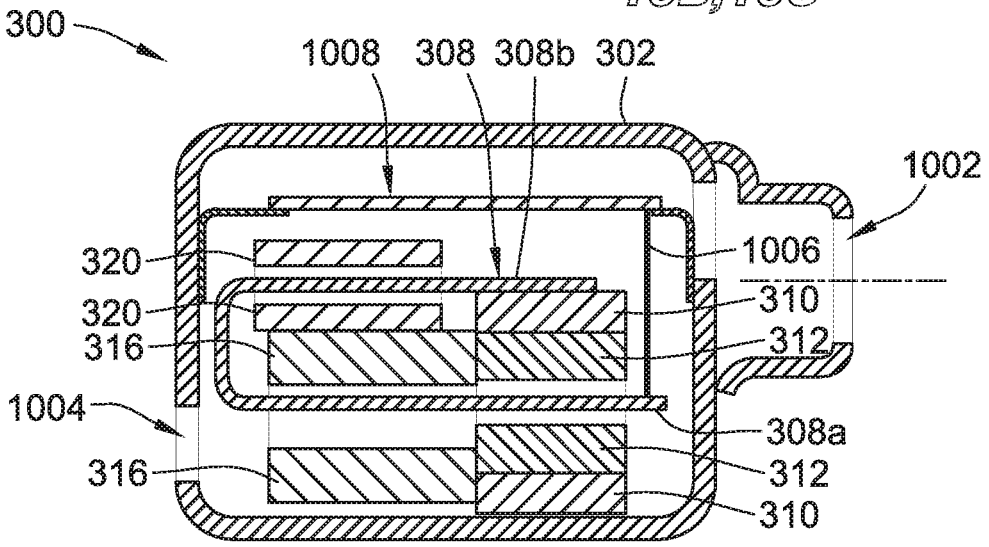
FIG. 10B shows a perspective view of the internal components of the balanced armature receiver of FIG. 10A, with an acoustic valve in an open position, in accord with aspects of the present disclosure.
Figure 10C:
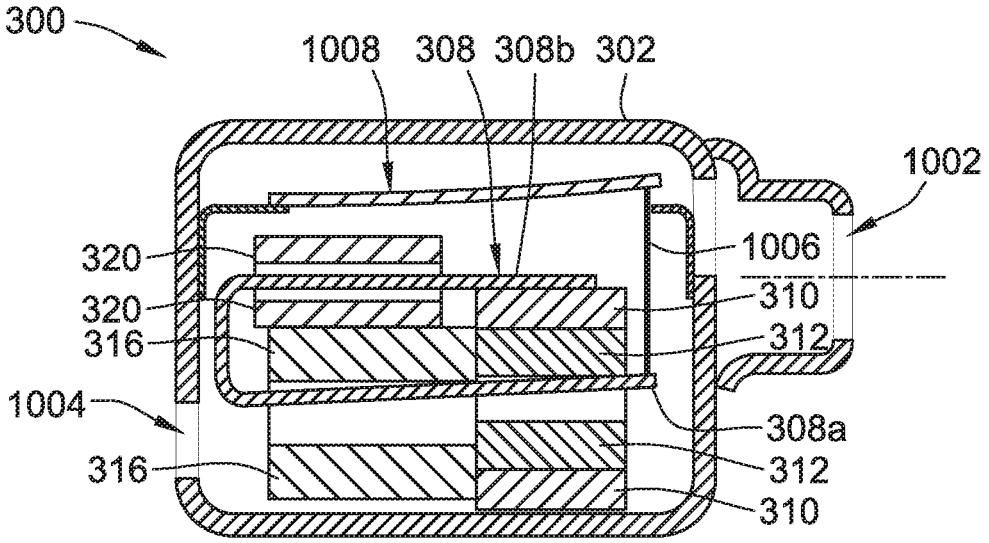
FIG. 10C shows a perspective view of the internal components of the balanced armature receiver of FIG. 10A, with the acoustic valve in the closed position, in accord with aspects of the present disclosure.

FIGS. 10A-10C show, for example, the balanced armature receiver 300, in accord with aspects of the present concepts. Thus, the elements shown in FIG. 3 discussed above are incorporated into the balanced armature receiver 300 of FIG. 10. The housing 302 further includes an aperture 1002. The aperture directs acoustic signals generated by the diaphragm (not shown), which is driven by the armature portion 306*a* discussed above. The housing 302 further includes an aperture 1004. The apertures 1002, 1004 generally allow for acoustic signals to pass through the interior of the balanced armature receiver 300. Thus, an acoustic pathway is generally formed between the apertures 1002, 1004 within the balanced armature receiver 300. Although the apertures 1002, 1004 are shown in the front and back of the housing 302, the locations of the apertures 1002, 1004 may vary without departing from the spirit and scope of the present disclosure.

In addition to the elements discussed above with respect to FIG. 3, the balanced armature receiver includes a drive rod 1006 and a valve 1008. The drive rod 1006 connects the armature portion 308*a* to the valve 1008. In a closed position, the valve 1008 sits on a valve seat 1010. In one embodiment, the valve 1008 may be a hinged valve such that, for example, the end 1008*a* of the valve 1008 is fixed to the valve seat 1010 and the end 1008*b* of the valve 1008 is free to move relative to the valve seat 1010. Alternatively, the entire valve 1008 may be free so that the entire valve is free to move relative to the diaphragm 1010. According to some embodiments, a restoring force can be supplied using a spring as a resilient member, such as to restore the valve 1008 to an open or closed position. The hinge can be made as torsion hinge or normal (door hinge).

FIGS. 10B and 10C show cross-sectional views of the balanced armature receiver 300 through the line 10B, 10C. Because the line 10B, 10C divides the balanced armature receiver 300 down the left side, FIGS. 10B and 10C show the armature portion 308*a* of the armature assembly 304. However, based on the configuration shown above in FIG. 3, the armature portion 306*a*, for example, is also included within the housing 302, although not shown based on the location of the line 10B, 10C.

FIG. 10B shows the valve 1008 in a closed position, seated against the valve seat 1010. In such a configuration, the armature portion 308*a* is near or at the lower extreme of the travel length and extends toward the lower magnet 312. By way of example, and without limitation, with the valve 1008 in the closed position, the armature portion 308*a* is magnetically affixed to the lower magnet 312 in one of the bi-stable states. Although shown and described as touching or affixed to the lower magnet 312, the armature portion 308*a* may not be touching the magnet 312 but still be held in a magnetically bi-stable state such that the magnet flux provided by the magnet is sufficient to maintain the armature portion 308*a* in the bi-stable state. With the valve 1008 closed, the acoustic pathway through the housing 302 is closed such that the balanced armature receiver 300 is configured according to a closed fitting configuration.

Referring to FIG. 10C, FIG. 10C shows the valve 1008 in an open position, not seated against the valve seat 1010. In such a configuration, the armature portion 308*a* is at or near the upper extreme of the travel length and extends toward the upper magnet 312. By way of example, and without limitation, with the valve 1008 in the open position, the armature portion 308*a* is magnetically affixed to the upper magnet 312 in one of the bi-stable states. Although shown and described as touching or affixed to the upper magnet, the armature portion 308*a* may not be touching the magnet 312 but still be held in a magnetically bi-stable state such that the magnet flux provided by the magnet is sufficient to maintain the armature portion 308*a* in the bi-stable state. With the valve 1008 open, the acoustic pathway through the housing 302 is open such that the balanced armature receiver 300 is configured according to an open fitting configuration.

Thus, the armature portion 308*a* within the balanced armature receiver 300 forms an active valve in combination with the drive rod 1006 and the valve 1008. Control of one or both of the electric drive coils 316 and 320 allows the armature portion 308*a* to remain in the desired bi-stable state and the valve 1008 in the corresponding desired open or closed state. Moreover, based on one or more of the mechanical and/or magnetic qualities of the balanced armature receiver 300, the armature portion 306*a*, and the armature 308*a*, according to any one of the embodiments described above, the armature portion 308*a* may remain in the desired bi-stable state while the armature portion 306*a* drives the diaphragm to generate the acoustic signals.

One or more electrical current pulses to the electric drive coil 316 and/or 320 allow for the armature portion 308*a* to switch to the other bi-stable state, to open or close the valve. Such an electrical current pulse may be provided by a controller after a determination is made to change the fitting of the balanced armature receiver. For example, a digital signal processor (DSP) may analyze acoustical information to determine that a user wearing a hearing air that incorporates the balanced armature receiver 300 has entered into a noisy environment. Accordingly, the DSP may generate an electrical current pulse to switch the valve 1008 from the open fitting to the closed fitting. With the closed fitting, a greater range of gain is achievable to increase the volume relative to the noisy environment. By way of another example, a user may be wearing in-ear headphones that incorporate the balanced armature receiver 300. While not playing music, the user may still have the in-ear headphones in his or her ears. By default, the balanced armature receiver 300 may be in an open fitting. Upon beginning to play music, the device playing the music, such as a smartphone or other audio device, may send an electrical current pulse to the balanced armature receiver 300 to switch to a closed fitting. Alternatively, the user may manually switch the balanced armature receiver 300 to a closed or open fitting by manually selecting a switch on a smartphone or directly on the balanced armature receiver 300 or acoustic device that incorporates the balanced armature receiver 300.

Because of the unstable nature of the armature portion connected to the acoustic valve, according to some embodiments, the balanced armature receiver and/or other controller (DSP, smartphone, etc.) can determine in which position the acoustic valve is, i.e., open, close, or neither. Such detection may be beneficial if, for example, the user drops the balanced armature receiver, which causes the valve armature portion to switch states. In such a case, the valve armature portion can always restore the acoustic valve to one defined condition, such as open or closed. Preferably, the default position is an open fitting. According to some embodiments, there may be an indication. Such an indication may be beneficial for hearing aids because of the higher energy efficiency. The balanced armature receivers can further include other components, such as a vibration sensor to measure if the balanced armature receiver has dropped, or dropped with a certain acceleration. The balanced armature receiver can then reset the acoustic valve to a first state or go to the state that user wants (e.g., preferred state). The sensor may be a microelectromechanical systems (MEMS) to detect the acceleration.

Although described above as being a hinged or non-hinged valve 1008, the valve 1008 may have various other forms without departing from the spirit and scope of the present disclosure. Certain forms may be, for example, an electro-active polymer valve, and/or concentric tubes to open/close a pathway. The valve may be flexible to avoid tolerances for completely open/closed conditions. According to a specific example, for a resilient member, such as a classic spring, the resilient member has only one stable state, such as at zero elongation for a classic spring. However, the resilient member can be modified to have additional stable states. For example, certain membranes can be thought of as having resiliency in that the membranes tend to restore to a stable state, such as flat. Deformations can be made to the membranes to modify the membranes to have more than one stable state. For example, using corrugations or grooves, a membrane can be designed to have two stable states. Such a membrane can be used as a flip-flop valve.

Figure 11B:
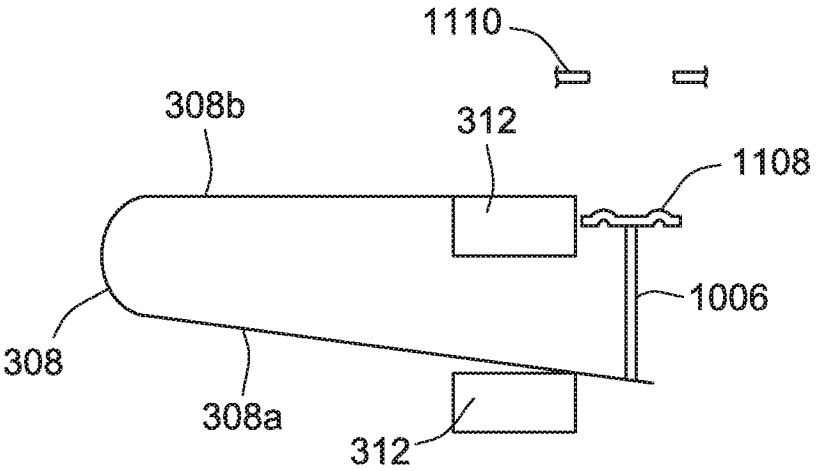
FIG. 11B shows the membrane-based flip-flop valve of FIG. 11A in a first state, in accord with aspects of the present disclosure.
Figure 11C:
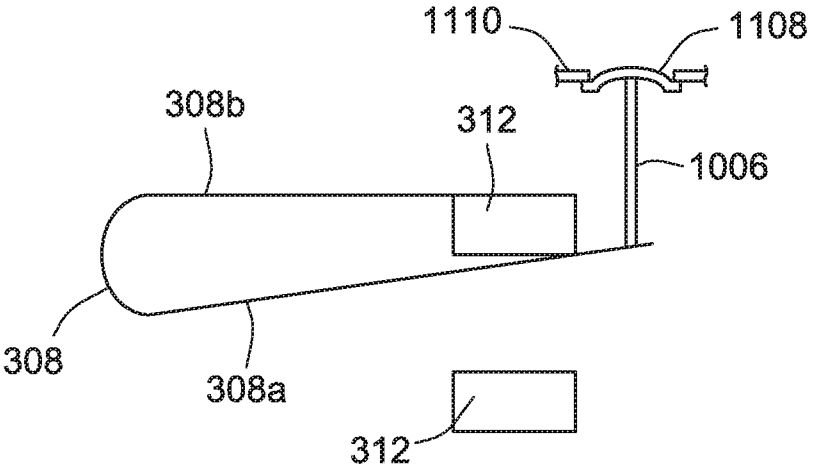
FIG. 11C shows the membrane-based flip-flop valve of FIG. 11A in a second state, in accord with aspects of the present disclosure.
Figure 11A:
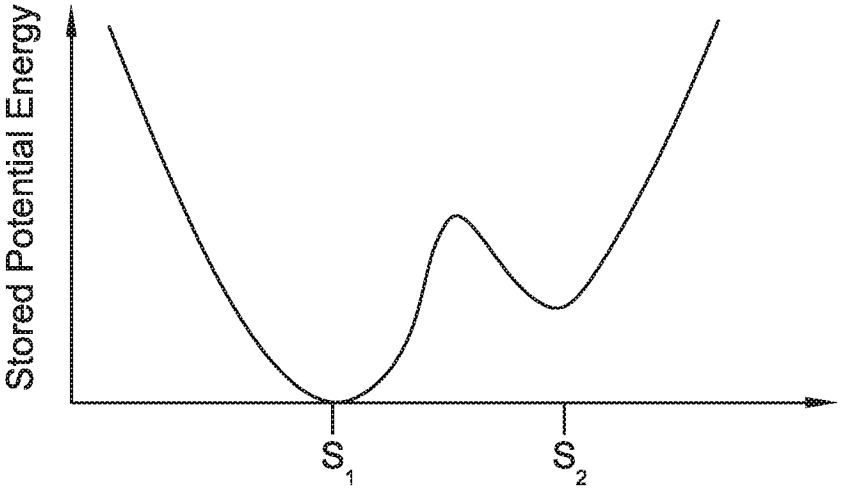
FIG. 11A shows the potential energy versus elongation of a membrane-based flip-flop valve, in accord with aspects of the present disclosure.

FIG. 11A shows the potential energy versus elongation of a membrane-based flip-flop valve 1108, in accord with aspects of the present disclosure. The membrane-based flip-flop valve 1108 is bi-stable or has two stable states corresponding to elongations of $S_1$ and $S_2$. FIGS. 11B and 11C show, in part, the corresponding side profiles of the states corresponding to the elongations $S_1$ and $S_2$. If the membrane-based flip-flop valve 1108 is put in elongation $S_1$ or $S_2$, the membrane-based flip-flop valve 1108 stays in this state. If a force acts on the membrane-based flip-flop valve 1108, the force needs to overcome the local maximum potential $P_1$ to get into the other stable state. Accordingly, forces that act on the membrane-based flip-flop valve 1108 that are less than the local maximum potential $P_1$ have no effect on the state.

FIG. 11B shows the membrane-based flip-flop valve 1108 in a first state corresponding to the elongation $S_1$, and FIG. 11C shows the membrane-based flip-flop valve 1108 in a second state corresponding to the elongation $S_2$. Thus, the membrane-based flip-flop valve 1108 may include bump that is either not deflected (FIG. 11B) or deflected (FIG. 11C). The membrane-based flip-flop valve 1108 can be formed of various materials, such as metals and plastics. If the membrane-based flip-flop valve 1108 is made out of plastics, the valve 1108 may not make sounds when switching between states, which may otherwise distract the user.

The first state shown in FIG. 11B corresponds to the membrane-based flip-flop valve 1108 being in an open configuration, and the second state shown in FIG. 11C corresponds to the membrane-based flip-flop valve 1108 being in a closed configuration. Accordingly, to switch from the first state in FIG. 11B to the second state in FIG. 11C, a force greater than $P_1$ must be applied to the membrane-based flip-flop valve 1108.

FIGS. 11B and 11C show the membrane-based flip-flop valve 1108 in the context of the armature portion 308*a* discussed above. However, the membrane-based flip-flop valve 1108 is applicable to any of the armature portions discussed above. It may be desirable to not require the complete range of movement of the armature portion 308*a*. For example, distortions may occur that would otherwise apply a force to a valve connected to the armature portions (e.g., armature portion 308*a*). However, the membrane-based flip-flop valve 1108 can be used to reduce the effect of the distortions. The drive rod 1006 may not be fixed to the armature portion 306*b* or the valve 1108 to allow the armature portion 308*a* to move within the audio operation range without touching the membrane-based flip-flop valve 1108. If the armature portion 308*a* is driven, such as by using a bias or direct current signal with voltages outside the audio operation range, the drive rod 1006 can be moved upwards or downwards and thereby switch membrane-based flip-flop valve 1108 between its stable states. This can then be used to open or close the aperture 1110 to open or close an acoustic pathway. Alternatively, the drive rod 1006 can be fixed to the membrane-based flip-flop valve 1108. Distortions within the magnetic flux generated by an electric drive coil associated with the armature portion 308*a* connected to the drive rod 1006 may cause the drive rod 1006 to apply forces to the membrane-based flip-flop valve 1108. However, these forces may be less than the local maximum potential $P_1$ of the membrane-based flip-flop valve 1108 such that the forces do not change the state of the membrane-based flip-flop valve 1108. Accordingly, the membrane-based flip-flop valve 1108 may be fully seated in, for example, the first state shown in FIG. 11C. Thus, the forces applied to the membrane-based flip-flop valve 1108 that are less than the local maximum potential $P_1$ do not affect the sealing ability of the membrane-based flip-flop valve 1108 against the valve seat 1110.

The membrane-based flip-flop valve 1108 provides one embodiment of a valve that can be used in any of the embodiments disclosed herein. Moreover, based on the two stable states corresponding to elongations of $S_1$ and $S_2$, the membrane-based flip-flop valve 1108 is stable independent of an electric current applied to an electric drive coil associated with the armature portion 308*a*.

Figure 12:
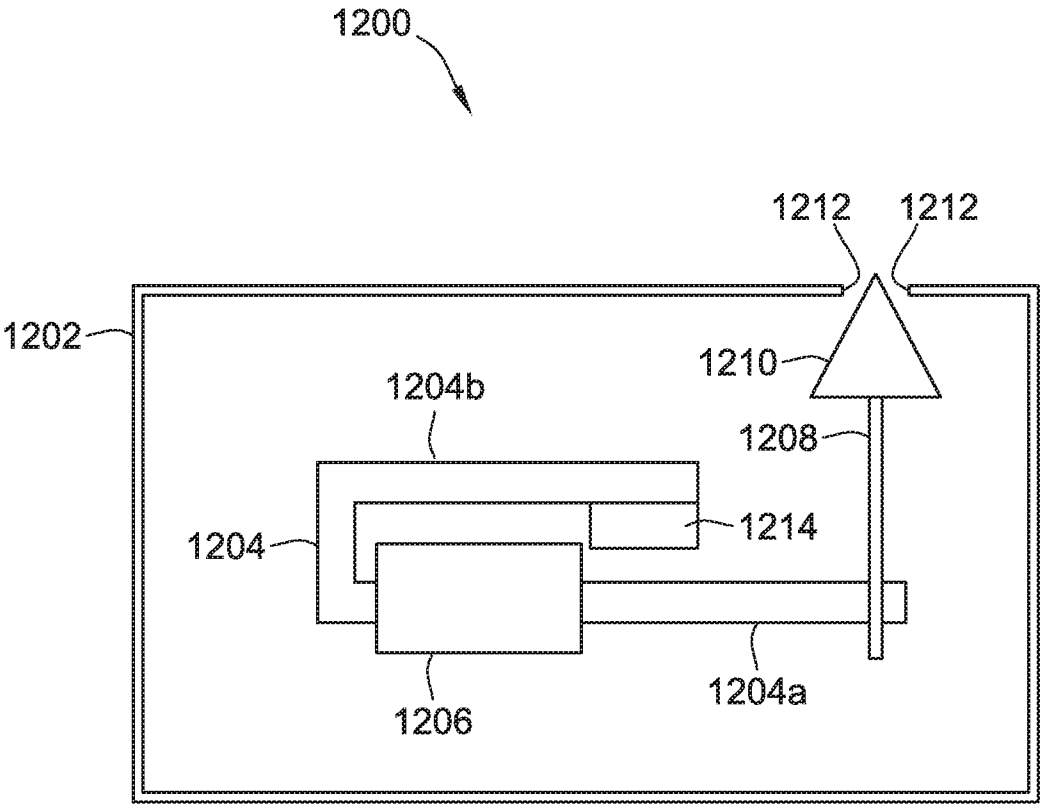
FIG. 12 shows an active valve formed independent of a balanced armature receiver, in accord with aspects of the present disclosure.

FIG. 12 shows an active valve 1200 formed independent of a balanced armature receiver, in accord with aspects of the present disclosure. However, although described as a valve, the structure can be used for additional and/or alternative purposes, such as an electrical switch, a shock protector, etc. The active valve 1200 is formed based according to the principles discussed herein. Yet, the active valve 1200 is not part of a balanced armature receiver such that, for example, the active valve 1200 does not include a balanced armature receiver within the housing 1202. Rather, the housing 1202 includes a single armature 1204. The armature 1204 includes a deflectable armature portion 1204*a* and a fixed armature portion 1204*b*. The active valve 1200 further includes an electric drive coil 1206. Connected to the deflectable armature portion 1204*b* is a drive rod 1208. At the end of the drive rod 1208 is a valve head 1210. The valve head 1210 seats against a valve seat 1212. Attached to the fixed armature portion 1204*b* is a ferromagnetic element 1214.

Although shown as surrounding the deflectable armature portion 1204*a*, alternatively the electric drive coil 1206 can surround the fixed armature portion 1204*b*. The electric drive coil 1206 can be formed independent of the armature 1204. Alternatively, the electric drive coil 1206 can be formed with the armature 1204, such as the windings being wrapped around the electric drive coil 1206. The electric drive coil 1206 can be attached directly to the armature 1204 or can be attached indirectly to the armature 1206, such as both being attached to the housing 1202.

Upon the electric drive coil 1206 being energized, magnetic flux generated by the energized electric drive coil 1206 causes the deflectable armature portion 1204*a* to deflect towards the ferromagnetic element 1214. The deflectable armature portion 1204*a* deflecting upwards causes the drive rod 1208 to travel upwards forcing the valve head 1210 against the valve seat 1212, sealing the aperture formed by the valve seat 1212. Upon de-energizing the electric drive coil 1206, the deflectable armature portion 1204*a* returns to its at rest position, which lowers the drive rod 1208 and valve head 1210 and opens the aperture at the valve seat 1212. Accordingly, control of the energized state of the electric drive coil 1206 allows for control of the closed or open position of the aperture with the valve head 1210. According to some embodiments, the ferromagnetic element 1214 can be instead a permanent magnet. With a permanent magnet, the deflectable armature portion 1204*a* can remain magnetically affixed to the permanent magnet after de-energizing the electric drive coil.

Figure 13A:
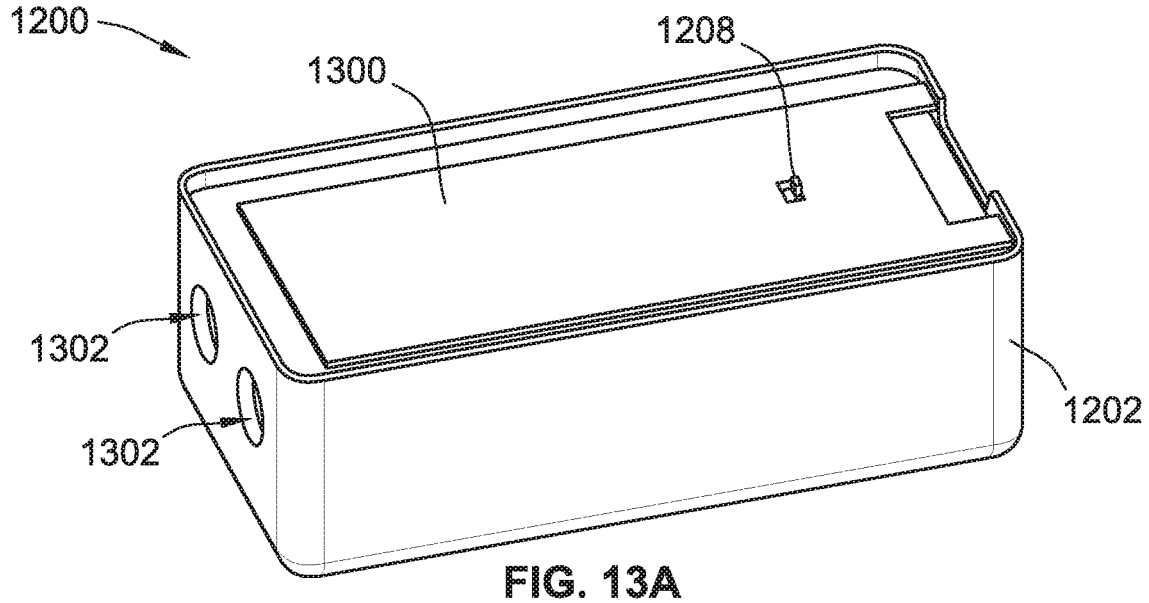
FIG. 13A shows the active valve of FIG. 12 in the form of an acoustic valve in an open position, in accord with aspects of the present disclosure.
Figure 13B:
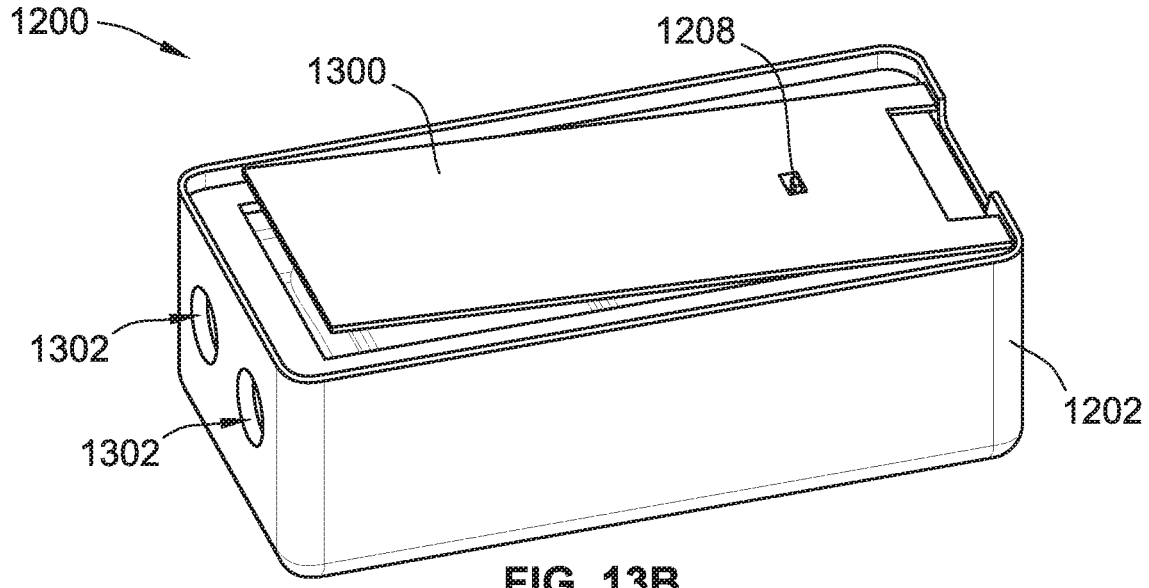
FIG. 13B shows the active valve of FIG. 12 in the form of an acoustic valve in a closed position, in accord with aspects of the present disclosure.

FIGS. 13A and 13B show the active valve 1200 in the form of an acoustic valve in an open and closed position, according to aspects of the present disclosure. That is, the acoustic valve is based on the active valve 1200 shown in FIG. 12. However, the valve head 1210 is replaced with a hinged valve 1300. The hinged valve 1300 opens at one end opposite of a hinged end. The housing 1202 includes ports 1302 that allow for air to enter and exit the interior of the housing 1202. In a de-energized state of the electric drive coil 1206, the hinged valve 1300 is in a closed position. Accordingly, air is restricted from entering and exiting the housing 1200 through the hinged valve 1300. However, with the electric drive coil 1206 in the energized state, the hinged valve 1300 is opened. Accordingly, an acoustic pathway is created between the opening at the ports and the opening through the hinged valve 1300.

Based on the position of the drive rod 1208 coupled to the hinged valve 1300, a mechanical advantage factor can be created. Specifically, with the drive rod 1208 coupled to the hinged at one half to one tenth of the length of the hinged valve 1300 from the hinged end, a mechanical advantage factor of 2 to 10 is created. Accordingly, a small travel distance of the drive rod 1208 can make a larger opening at the end of the hinged valve 1300 opposite from the hinge.

Although shown in the context of the active valve 1200, the configuration of the valve 1200 can be used in any of the embodiments discussed herein, such as any of the embodiments of the balanced armature receiver with acoustic valve discussed in FIGS. 1A-10C.

Figure 14:
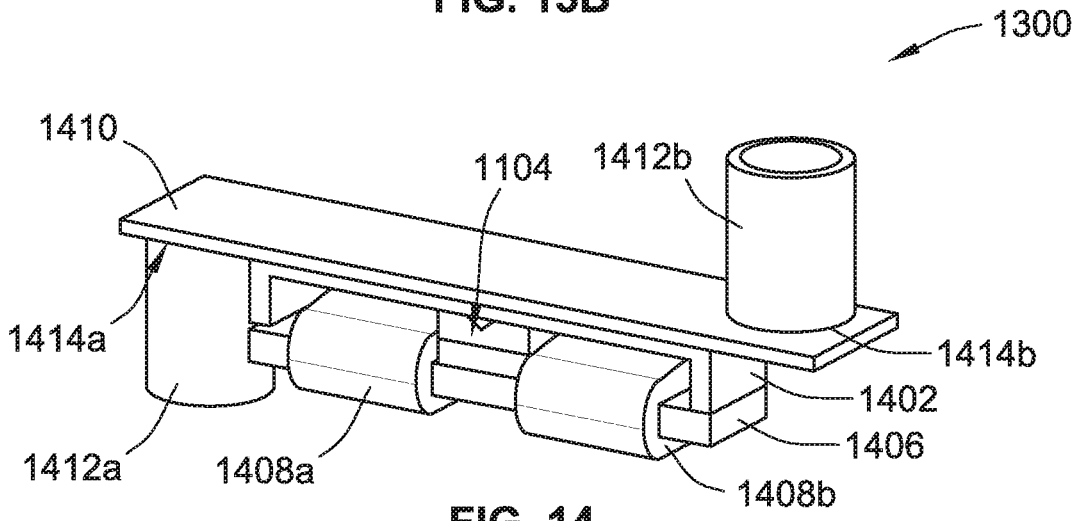
FIG. 14 shows a relay based on the active control of a balanced armature, in accord with aspects of the present disclosure.

FIG. 14 shows a relay 1400 based on an active control of an armature, in accord with aspects of the present concepts. The relay 1400 includes an armature 1402. The armature 1402 sits on a pair of magnets 1404. The pair of magnets 1404 sits on a core 1406. Wrapped around the core 1406 are electric drive coils 1408*a*, 1408*a*. On top of the armature 1402 is a platform 1410. The platform 1410 forms valve seats 1412*a*, 1412*b* around vent channels 1414*a*, 1414*b*. Operation of the electric drive coils allows for independent closing and opening of the valve seats 1414*a*, 1414*b* by bending, in part, of the platform 1410.

Figure 15B:
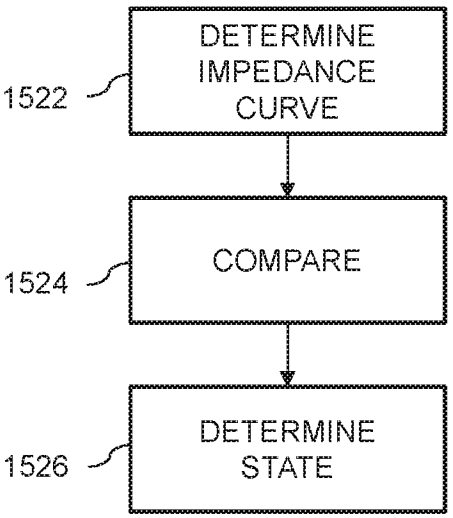
FIG. 15B shows a flow diagram for detecting a state of an acoustic valve coupled to a balanced armature within a balanced armature receiver, in accord with aspects of the present disclosure.
Figure 15A:
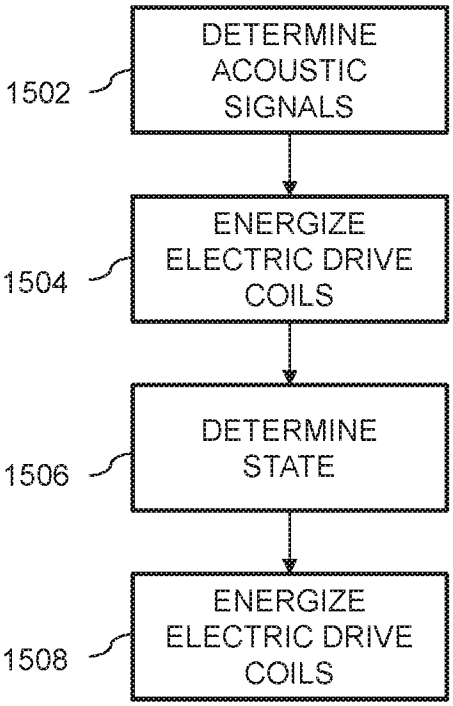
FIG. 15A shows a flow diagram for using a balanced armature receiver with an integrated acoustic valve, in accord with aspects of the present disclosure.

FIG. 15A shows a flow diagram for using a balanced armature receiver with an integrated acoustic valve, in accord with aspects of the present concepts. At step 1502, one or more acoustic signals external to the receiver are determined. At step 1504, one or more electric drive coils associated with a first armature are energized to reproduce the one or more acoustic signals with the diaphragm. At step 1506, a state of the acoustic valve is determined based on the reproduction of the one or more acoustic signals. According to one embodiment, a frequency range of the one or more acoustic signals is analyzed to determine the state of the acoustic valve. At step 1508, one or more electric drive coils associated with the second armature are energized based, at least in part, on the state of the acoustic valve. According to one embodiment, the one or more electric drive coils associated with the second armature are energized based, at least in part, on the frequency range of the one or more acoustic signals. According to one embodiment, one or more inputs are received from an application executed on a smartphone, and the one or more electric drive coils associated with the valve armature portion are energized based, at least in part, on the one or more inputs.

FIG. 15B shows flow diagram for detecting a state of an acoustic valve coupled to a balanced armature within a receiver, in accord with aspects of the present concepts. At step 1522, an impedance curve is determined as a function of frequency through the balanced armature collapsed against one of two of permanent magnets. The magnetic hysteresis curves of the two permanent magnets vary. At step 1524, the determined impedance is compared to known impedances for the balanced armature collapsed against each of the two permanent magnets. At step 1526, a state of the acoustic valve is determined based on the comparison. Subsequently, an electric coil of the balanced armature is energized to change the state of the acoustic valve based on determining that the state is off.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the invention. It is also contemplated that additional embodiments according to aspects of the present invention may combine any number of features from any of the embodiments described herein.

What is claimed is:

1. A balanced armature receiver comprising:

a housing; and an armature assembly within the housing, the armature assembly including:

a first armature portion configured mechanically, magnetically, or a combination thereof to be stable in a balanced arrangement during operation of the balanced armature receiver; and a second armature portion configured mechanically, magnetically, or a combination thereof to be unstable relative to the first armature portion and in one of at least two states in an unbalanced arrangement during operation of the balanced armature receiver.

2. The receiver of claim 1, wherein the second armature portion is unstable relative to the first armature portion based, at least in part, on a difference in one or more mechanical or magnetic properties of the second armature portion relative to the first armature portion.

3. The receiver of claim 1, further comprising:

a first electric drive coil forming a first tunnel with a first central longitudinal axis; and a second electric drive coil forming a second tunnel with a second central longitudinal axis;

wherein the first armature portion is aligned with the first central longitudinal axis and extends through the first electric drive coil, the second armature portion is aligned with the second central longitudinal axis and extends through the second electric drive coil, and the second armature portion is unstable relative to the first armature portion based, at least in part, on a difference in energized states of the first electric drive coil relative to the second electric drive coil.

4. The receiver of claim 1, further comprising:

a first pair of permanent magnets forming a first gap between facing surfaces of the first pair of permanent magnets; and a second pair of permanent magnets forming a second gap between facing surfaces of the second pair of permanent magnets, each of the second pair of permanent magnets having a spacer coupled thereto, wherein the first armature portion extends within the first gap, the second armature portion extends within the second gap, and the second armature portion is unstable relative to the first armature portion based, at least in part, on a difference in magnetic strengths of the first pair of permanent magnets relative to the second pair of permanent magnets.

5. The receiver of claim 1, further comprising:

at least one permanent magnet on the second armature portion, wherein the second armature portion is unstable relative to the first armature portion and in the one of the at least two states in the unbalanced arrangement based, at least in part, on the at least one permanent magnet.

6. The receiver of claim 1, further comprising:

an acoustic pathway within the housing through which an acoustic signal travels;

an acoustic valve within the acoustic pathway; and a drive pin coupling the second armature portion to the acoustic valve, wherein the one of at least two states in the unbalanced arrangement corresponds to the acoustic valve being either substantially open or substantially closed during operation.

7. The receiver of claim 1, wherein the receiver is incorporated into a hearing aid or a personal listening device.

8. A receiver, comprising:

a housing;

a balanced armature receiver within the housing and having an armature; and a second armature also within the housing and configured to be electromechanically operated to impart mechanical movement to a valve substantially independently of movement of the armature of the balanced armature receiver.

9. The receiver of claim 8, wherein the second armature draws an electrical current pulse only to impart the mechanical movement to the valve.

10. The receiver of claim 8, wherein the second armature imparts mechanical movement to the valve between at least two distinct positions.

11. The receiver of claim 10, wherein the at least two distinct positions include an open position for the valve and a closed position for the valve, the valve permitting acoustic signals to pass around the valve in the open position, and the valve substantially inhibiting acoustic signals from passing through the valve in the closed position.

12. The receiver of claim 8 incorporated into a personal listening device, wherein the second armature is electromechanically operated to impart mechanical movement to switch the valve between two states based, at least in part, on one or more user inputs.

13. The receiver of claim 8, wherein the receiver includes a common coil that surrounds the armature of the balanced armature receiver and the second armature.

14. The receiver of claim 13, wherein the common coil is connected directly to the second armature.

15. The receiver of claim 8, wherein the second armature is a balanced armature, the balanced armature receiver includes a coil imparting electromagnetic energy to the armature of the balanced armature receiver, and the receiver includes a second coil imparting electromagnetic energy to the second armature.

16. The receiver of claim 8, wherein the second armature imparts the mechanical movement to the valve based on at least a frequency of sound produced by the balanced armature receiver.

17. A balanced armature receiver comprising:

an electric drive coil forming a tunnel with a central longitudinal axis;

a first pair of permanent magnets forming a first gap between facing surfaces of the first pair of permanent magnets, the first gap being parallel to the central longitudinal axis;

an armature assembly including:

a first deflectable armature extending longitudinally through the tunnel and within the first gap; and a second deflectable armature extending longitudinally through the tunnel;

a drive rod coupling the second deflectable armature to an acoustic valve, wherein the second deflectable armature is electromechanically operated to impart mechanical movement to the acoustic valve substantially independent of mechanical movement of the first deflectable armature.

18. The receiver of claim 17, wherein the second deflectable armature extends within the gap, and the second deflectable armature is substantially independent based, at least in part, on a difference in one or more mechanical properties of the second deflectable armature relative to the first deflectable armature.

19. The receiver of claim 17, wherein the second deflectable armature is bi-stable such that the acoustic valve remains closed or open independent of an energized state of the electric drive coil.

20. The receiver of claim 17, further comprising:

a magnet coupled to the second deflectable armature, wherein the second deflectable portion is substantially independent based, at least in part, on the magnet.

* * * * *